US006470840B2

(12) United States Patent
Ebesu et al.

(10) Patent No.: US 6,470,840 B2
(45) Date of Patent: Oct. 29, 2002

(54) CYLINDER HEAD STRUCTURE

(75) Inventors: Hidesaku Ebesu; Hiroyuki Oda; Kouji Asanoumi; Hiroaki Deguchi; Setsuo Harada; Hirokazu Matsuura, all of Hiroshima-Ken (JP)

(73) Assignee: Mazda Motor Corporation, Hiroshima-Ken (JP)

( * ) Notice: Subject to any disclaimer, the term of this patent is extended or adjusted under 35 U.S.C. 154(b) by 0 days.

(21) Appl. No.: 09/804,071

(22) Filed: Mar. 13, 2001

(65) Prior Publication Data

US 2001/0035142 A1 Nov. 1, 2001

(30) Foreign Application Priority Data

Mar. 13, 2000 (JP) ..... 2000-068173
Nov. 17, 2000 (JP) ..... 2000-350793

(51) Int. Cl.[7] ..... F01L 1/34

(52) U.S. Cl. ..... 123/90.17; 123/90.33; 123/90.16; 123/90.27; 123/90.34

(58) Field of Search ..... 123/90.17, 193, 123/90.16, 90.27, 90.48, 193.5

(56) References Cited

U.S. PATENT DOCUMENTS 5,080,057 A * 1/1992 Batzill et al. ..... 123/193
5,345,898 A * 9/1994 Krebs ..... 123/90.17
5,758,612 A * 6/1998 Tsuzuku et al. ..... 123/90.16
6,135,074 A * 10/2000 Kuhl ..... 123/90.16

FOREIGN PATENT DOCUMENTS

| | | |
|---|---|---|
| JP | 4-91351 | 3/1992 |
| JP | 6-146822 | 5/1994 |
| JP | 7-103068 | 4/1995 |
| JP | 8-74540 | 3/1996 |
| JP | 2597935 | 1/1997 |
| JP | 5-86813 | 4/1998 |
| JP | 11-148426 | 6/1999 |

* cited by examiner

*Primary Examiner*—Thomas Denion
*Assistant Examiner*—Sean O'Brien
(74) *Attorney, Agent, or Firm*—Nixon Peabody LLP; Donald R. Studebaker

(57) ABSTRACT

A cylinder head includes a carrier member 50 integrally formed with a vertical wall portion 53 for supporting a camshaft 15, 16, a tappet guide 54 for containing a tappet 24 and a tappet-lubricating oil receiving portion 51 slanted around the tappet guide 54. An operation-oil supply passage 203, 209, 210 extends in the longitudinal direction of the carrier member 50 inside the tappet guide 54.

7 Claims, 14 Drawing Sheets

CYLINDER HEAD STRUCTURE

FIELD OF THE INVENTION

The present invention relates to an internal combustion engine for automobiles or the like, more particularly to a cylinder head structure defining the upper part of an engine body of an internal combustion engine.

BACKGROUND OF THE INVENTION

Typically, in a combustion chamber for each cylinder of an internal combustion engine, an intake port is provided with an intake valve for opening/closing the intake port to induct an air or mixture into the combustion chamber, while an exhaust port is provided with an exhaust port for opening/closing the exhaust port to discharge an expanded combustion gas from the combustion chamber. Currently, for valve mechanisms for driving and/or controlling the opening/closing motions of such intake and exhaust valves, there are widely used various types including an overhead-valve (OHV) type wherein a camshaft is arranged in the side region of a crankcase, a single overhead camshaft (SOHC) type wherein a camshaft is arranged in the upper region of a cylinder head and the intake and exhaust valves are driven by a single camshaft, or a double overhead camshaft (DOHC) type wherein a camshaft is arranged in the upper region of a cylinder head and the intake and exhaust valves are driven separately by individual camshafts.

As compared to the OHV engine, the SOHC and DOHC engines are superior in high-speed performance. Conversely, relatively long distance between the camshaft and crankshaft of the SOHC and DOHC engines can lead to a complicated driving arrangement of the camshaft and a complicated cylinder head structure.

The valves of the SOHC engine are driven indirectly by the camshaft through a rocker arm. In contrast, the valves of the DOHC engine are driven directly by the camshaft. In the DOHC engine, a tappet or lifter is employed as a follower element which is contacted continuously with the cam surface of the camshaft so as to convert the rotational motion of the cam into the reciprocating motion to be transferred to the valves. As a carrying element for containing and guiding the tappet, a tappet guide or lifter guide is formed integrally with the cylinder head by casting, or otherwise is separately formed and then incorporated in the cylinder head.

On the other hand, each of bearing portions each having a journal portion for supporting the camshaft is comprised of a vertical wall portion protruding vertically from the base portion of the cylinder head and a cam cap coupled with the vertical wall portion. The vertical wall portion is formed integrally with the cylinder head by casting, or otherwise is separately formed and then incorporated in the cylinder head. In order to assure the supporting rigidity of the camshaft, the bearing portion is arranged close to the cam located for each valve.

Taking a four-valve type engine having a pair of intake ports and intake valves and a pair of exhaust ports and exhaust valves for each cylinder as an example, a pair of intake valve driving cams or a pair of exhaust valve driving cams are aligned on the camshaft. Two adjacent bearing portions are located on both sided of the pair of intake valve cams or the pair of exhaust valve cams with interposing these cams between the bearing portions, and more specifically each bearing portion is located in the outboard region of a cylinder and between said cylinder and another cylinder adjacent to said cylinder. Otherwise, each bearing portion is located between the pair of intake valve cams or the pair of exhaust valve cams with being interposed between these cams, and more specifically the bearing portion is located in the outboard region of a cylinder and at a position corresponding to the center of said cylinder.

However, in case that a variable valve timing (VVT) control and/or variable valve lift (VVL) control device for varying the valve timing and/or valve-lift amount of the intake and/or exhaust valves in response to driving conditions is applied to improve fuel consumption and output power, a plurality of cams each having a different cam profile in valve-opening timing or valve-lift amount, for example, are provided for each valve, and this results in the increased number of cams for each cylinder. For example, in the above-exemplified engine, the bearing portion may be hardly to be arranged at the position corresponding to the center of the cylinder, and thereby will be arranged between adjacent cylinders. In this case, if the number of cams for each valve is not more than two, the bearing portion is not required to locate excessively far from the position corresponding to the center of the cylinder. However, if the number of cams for each valve is increased, for example, up to 3 or more, the bearing portion is required to locate far from the position corresponding to the center of the cylinder and consequently locates at approximately middle position between the cylinder and another cylinder adjacent to the cylinder.

Unfortunately, in the middle portion between adjacent cylinders, a cylinder head bolt for securing the cylinder head to a cylinder block is necessarily located to evenly receive the stress due to the combustion pressure in the cylinder, which leads to the interference between the cylinder head bolt and the bearing portion. For measures to this problem, the cylinder head may be fastened to a cylinder block by using in common a bolt for uniting the cam cap with the vertical wall portion. However, this undesirably results in a lengthened cylinder head bolt and excessively enlarged bearing portion.

On the other hand, separately mounting the vertical wall portion or tappet guide to the cylinder head leads to the increased number of parts, a complexified cylinder head structure, and a lowered flexibility of cylinder head layout. This causes problems, such as the significantly increased volume and height of the cylinder head. Further, in the engine having the variable valve control device, the cylinder head is required to firmly support associated components including an oil pressure control valve for supplying an operating oil to a movable portion of the device.

A technique for reducing the number of parts of the cylinder head is, for example, disclosed in Japanese Patent Laid-Open Publication No. Hei 7-103068 wherein a cam cap for supporting the upper portion of a camshaft reliably secures a plug tube for an ignition plug to a cylinder head by pressing the plug tube in its axial direction with constraining the plug tube in its radial direction. Japanese Patent Laid-Open Publication No. Hei 5-86813 also discloses a related technique wherein an ignition-plughole is comprised of a lower ignition-plug hole formed in a cam carrier for supporting the lower portion of a camshaft and an upper ignition-plug hole formed in a cam cap for supporting the upper portion of the camshaft. However, these techniques cannot solve the above problems all at once.

It is known that a carrier member integrally including a vertical wall portion defining a bearing portion for a camshaft and a tappet guide for containing a tappet is formed separately to a cylinder head. For example, Japanese Patent Laid-Open Publication No. Hei 6-146822 discloses a related technique wherein a cam carrier integrally including at least a camshaft journal and a lifter guide portion is formed separately to a cylinder head, and the cam carrier is integrally fastened to a cylinder head body. Japanese Patent Laid-Open Publication No. Hei 8-74540 also discloses a related technique wherein a cam carrier having a plurality of cam bearing portions integrally connected with each other by guide bosses formed with lifter guide holes is prepared as respective intake and exhaust cam carriers to be mounted separately to a cylinder head.

Further, Japanese Patent No. 259735 discloses a related technique wherein a camshaft bearing pedestal doubling as a support member of a tappet is connected to a cylinder head. Japanese Patent Laid-Open Publication No. Hei 4-91351 also discloses a related technique wherein a carrier supporting a camshaft and formed with a tappet-carrying device is mounted on a cylinder head. Furthermore, Japanese Patent Laid-Open Publication No. Hei 11-148426 discloses a cylinder block on which an oil pressure control valve of a variable valve-timing (VVT) control device.

All of these techniques disclosed in the above publications are intended to assure the supporting rigidity of the camshaft and tappet. In case of housing the aforementioned variable valve control device in the tappet, it is required to comprehensively consider the oil distribution for overall valve system including the lubrication of the tappet itself and the camshaft in addition to the above object. However, any construction for achieving these needs is not discussed in the above publications.

For example, in the construction disclosed in Japanese Patent Laid-Open Publication No. Hei 6-146822, the surrounding sidewall of the lift guide portion extends obliquely upward to form a receiving region for receiving a lifter lubricating-oil. However, since the cam carrier disposed on the exhaust side employs a so-called inter-port bearing, or a camshaft journal is arranged between two adjacent lifter guide portions, it is difficult to arrange a plurality of cams for one valve. Thus, this construction is not inherently suitable for engines equipped with the aforementioned variable valve control device. Further, in case of applying the aforementioned variable valve control device, this publication discloses or suggests neither method for supplying operating oil to the device nor its presupposed element, such as an arrangement of lubrication oil channels of the camshaft.

Japanese Patent Laid-Open Publication No. Hei 8-74540 discloses a variable valve timing control device, a valve intermitting (valve stop) device, and an oil supply passage for the valve intermitting device provided in the can carrier and located in parallel with the camshaft. However, this publication does not discuss any lubrication oil channel for the camshaft, the tappet, and other fundamental components. Japanese Patent No. 259735, Japanese Patent Laid-Open Publication No. Hei 4-91351, and Japanese Patent Laid-Open Publication No. Hei 11-148426 do not describe any construction for lubricating the tappet.

SUMMARY OF THE INVENTION

In view of the aforementioned problems, it is an object of the present invention to provide an improved cylinder head capable of avoiding the interference between a cylinder head bolt and a camshaft bearing portion and achieving the reduced number of parts, an enhanced flexibility of layout, and an improved supporting rigidity.

It is another object of the present invention to provide an improved cylinder head structure including a tappet which houses a variable valve control device, capable of assuring a sufficient supporting rigidity of the tappet, camshaft, or the like, and comprehensively satisfying the oil distribution for an overall valve system including the operating oil supply to the variable valve control device, or the lubrication oil supply to the tappet or camshaft.

In order to achieve the above objects, according to a first aspect of the present invention, there is provided a cylinder head structure for an engine including a tappet which houses a variable valve control device for varying at least one of valve-lift amount and valve-opening timing. The cylinder head structure comprises a carrier member integrally formed with a vertical wall portion located between adjacent cylinder bores and having a bearing portion for supporting a camshaft and a tappet-carrying portion for containing the tappet for intake port or exhaust port. The carrier member is formed separately to a cylinder head. The cylinder head structure further comprises an oil supply passage for the variable valve control device, provided in the carrier member at the position closer to the central region of the carrier member than the position of the tappet-carrying portion. The oil supply passage extends along the direction in which the tappet-carrying portion is arranged in the carrier member. The cylinder head structure further comprises an oil-receiving portion for receiving a tappet-lubricating oil, provided in the periphery of the tappet-carrying portion. The oil-receiving portion couples the tappet-carrying portion with the vertical wall portion, and the marginal region of the oil-receiving portion is directed upward.

According to the first aspect of the present invention, the cylinder head structure includes the carrier member integrally formed with the vertical wall portion located between adjacent cylinder bores to support the camshaft and a tappet-carrying portion for containing the tappet for each intake or exhaust port, wherein the carrier member is formed separately to a cylinder head. Thus, the vertical wall portion defining a bearing portion and the tappet-carrying portion for guiding the tappet may be mounted to the cylinder head at once only by mounting the carrier member to the cylinder head. This allows the cylinder head structure to have the reduced number of parts, a simplified structure, and an enhanced layout performance. As a result, an enhanced assembling operation performance and a sufficiently downsized cylinder head structure may be achieved.

In this carrier member, since the vertical wall portion and tappet-carrying portion each having a different configuration are connected with each other, the carrier member may have a higher rigidity or stiffness by a complementary relationship therebetween. This may improve the supporting rigidity of the camshaft, tappet, oil-pressure control valve of the variable valve control device or the like.

Further, since the carrier member is formed separately to the cylinder head, the bearing portion defined by the vertical wall portion may avoid interfering with the cylinder head bolt and thereby the flexibility of the arrangement of the bearing portion is not restricted by the presence of the cylinder head bolt. Thus, the bearing portion may, for example, be arranged overlappedly above the head bolt without any trouble.

In addition to the above structure, the oil supply passage for the variable valve control device extends along the direction in which the tappet-carrying portion is arranged. Thus, sufficient operating oil may be supplied to the device, while the rigidity or stiffness of the carrier member may further be enhanced.

Further, since the oil-receiving portion for receiving the tappet-lubricating oil is provided around the tappet-carrying portion, the tappet may be adequately lubricated by the oil collected in the oil-receiving portion (external lubrication system). In addition, any dedicated oil supply passage is unnecessary to be formed in the carrier member so that the carrier member may avoid to be complexified in structure and may be readily manufactured.

Furthermore, since this cylinder head structure is applied with a so-called inter-bore bearing; specifically the vertical wall portion for supporting the camshaft is arranged between the adjacent bores, the overall valve system may be compactly arranged. As described above, according to the first aspect of the present invention, an improved carrier member having compact size and reliable rigidity and a sufficient oil distribution to the variable valve control device and tappet may be satisfied all at once.

In one specific embodiment, the oil supply passage for the variable valve control device may include a branched passage extending in the lateral direction of the carrier member, wherein the branched passage is configured to provide fluid communication with the tappet-carrying portion so as to supply oil to the variable valve control device.

According the above structure, the operating oil may be supplied to the variable valve control device through the oil supply passage for the variable valve control device. For example, when one branched passage has fluid communication with one tappet-carrying portion, said one tappet-carrying portion may be supplied with oil through said one branched passage. This allows the variable valve control device to be individually operated. Otherwise, when one branched passage has fluid communication simultaneously with a plurality of tappet-carrying portions, said one branched passage may introduce oil to the plurality of tappet-carrying portions so as to simultaneously operate a plurality of variable valve control devices.

In another specific embodiment of the present invention, the camshaft may further be provided with an inner oil channel extending in the longitudinal direction of the camshaft and an branched oil channel branched from the inner oil channel at the portion where the camshaft is supported by the bearing portion, so as to be opened at the peripheral surface of the camshaft. Further, the bearing portion is provided with an inner groove opposed to the opening. Furthermore, a camshaft-lubricating oil channel is provided in the bearing portion supporting the edge of the camshaft. The camshaft-lubricating oil channel is configured to provide fluid communication with the inner groove.

According the above structure, a sufficient lubrication to the camshaft may be achieved by providing the particular oil channels and inner groove in the conventional camshaft and bearing portion. In addition, any dedicated member is not additionally required so that the carrier member may avoid to be complexified in structure and may be readily manufactured.

According to a second aspect of the present invention, there is provided a cylinder head structure for a DOHC engine including a tappet which houses a variable valve control device for varying at least one of valve-lift amount and valve-opening timing. The cylinder head structure comprises a carrier member integrally formed with a vertical wall portion located between adjacent cylinder bores to support a camshaft and a tappet-carrying portion for containing the tappet for each intake or exhaust port located between the vertical wall portions adjacent to each other. The carrier member is formed separately to a cylinder head. The cylinder head structure further comprises a cam cap for supporting the camshaft in cooperation with the vertical wall portion. The cam cap is coupled with the vertical wall portion. The cylinder head structure further comprises an oilreceiving portion for receiving a tappet-lubricating oil, provided around the tappet-carrying portion of the carrier member. The oil-receiving portion couples the tappet-carrying portion with the vertical wall portion, and the marginal region of the oil-receiving portion is directed upward.

According to the second aspect of the present invention, the same effects as those of the first aspect of the present invention may be yielded in the DOHC engine. In particular, applying the inter-bore bearing allows cams provided in the camshaft to be arranged to the intake and/or exhaust port or the tappet-carrying portion with high flexibility, and thereby the variable valve control device may be freely mounted to the cylinder head structure even if the variable valve control device includes a plurality of cams for each valve.

In addition, the oil-receiving portion for receiving the tappet-lubricating oil is surrounded by the marginal region directed upward and the vertical wall portion which is increased in height by connecting the cam cap thereto, and the corresponding bearing portion is used as a oil separator. Thus, the oil collected in the oil-receiving portion may avoid to be excessively reduced and thereby sufficient lubrication of the tappet may be reliably maintained even by the external lubrication system.

Other features and advantages of the present invention will be apparent from the accompanying drawings and from the detailed description.

DESCRIPTION OF THE PREFERED EMBODIMENT

[Overall Structure of Engine]

Figure 1:
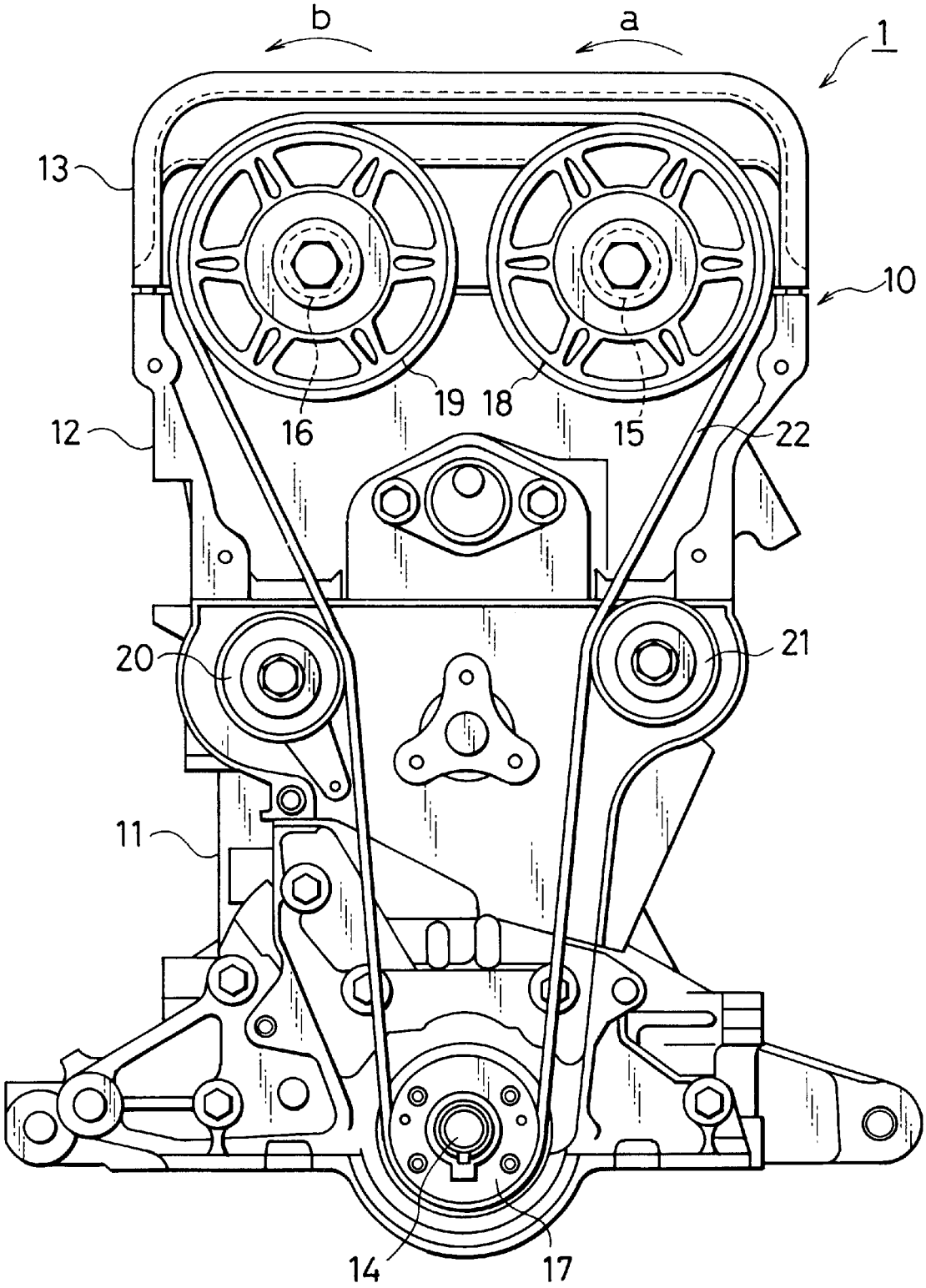
FIG. 1 is a schematic front view showing the overall construction of an engine according to an embodiment of the present invention.

FIG. 1 is a front view of an engine 1 according to an embodiment of the present invention taken from the front side of a vehicle body. This engine 1 is an in-line four-cylinder DOHC engine, and longitudinally arranged in an engine room of the front side of the vehicle body such that an axis of a crankshaft of the engine extends in the longitudinal direction of the engine room or the vehicle body. The engine body 10 includes a cylinder block 11, a cylinder head 12, and a head cover 13 to form an overall profile of the engine.

The front edge of a crankshaft 14 is protruded out of the lower region of the cylinder block 11, while each front edge of an intake-valve driving camshaft 15 and an exhaust-valve driving camshaft 16 is protruded out of the upper region of the cylinder head 12. A crank pulley 17 and cam pulleys 18, 19 are mounted to the protruded portions of the crankshaft 14 and the camshafts 15, 16, respectively. A pair of tension pulleys 20, 21 are mounted on the right and left sides of the front wall of the cylinder block 11, respectively. The intake camshaft 15 and the exhaust camshaft 16 are rotated in the "a " and "b " directions at an angular speed half of that of the crankshaft 14 by a timing belt 22 wound around these pulleys 17 to 21, respectively.

[Cylinder Head]

Figure 2:
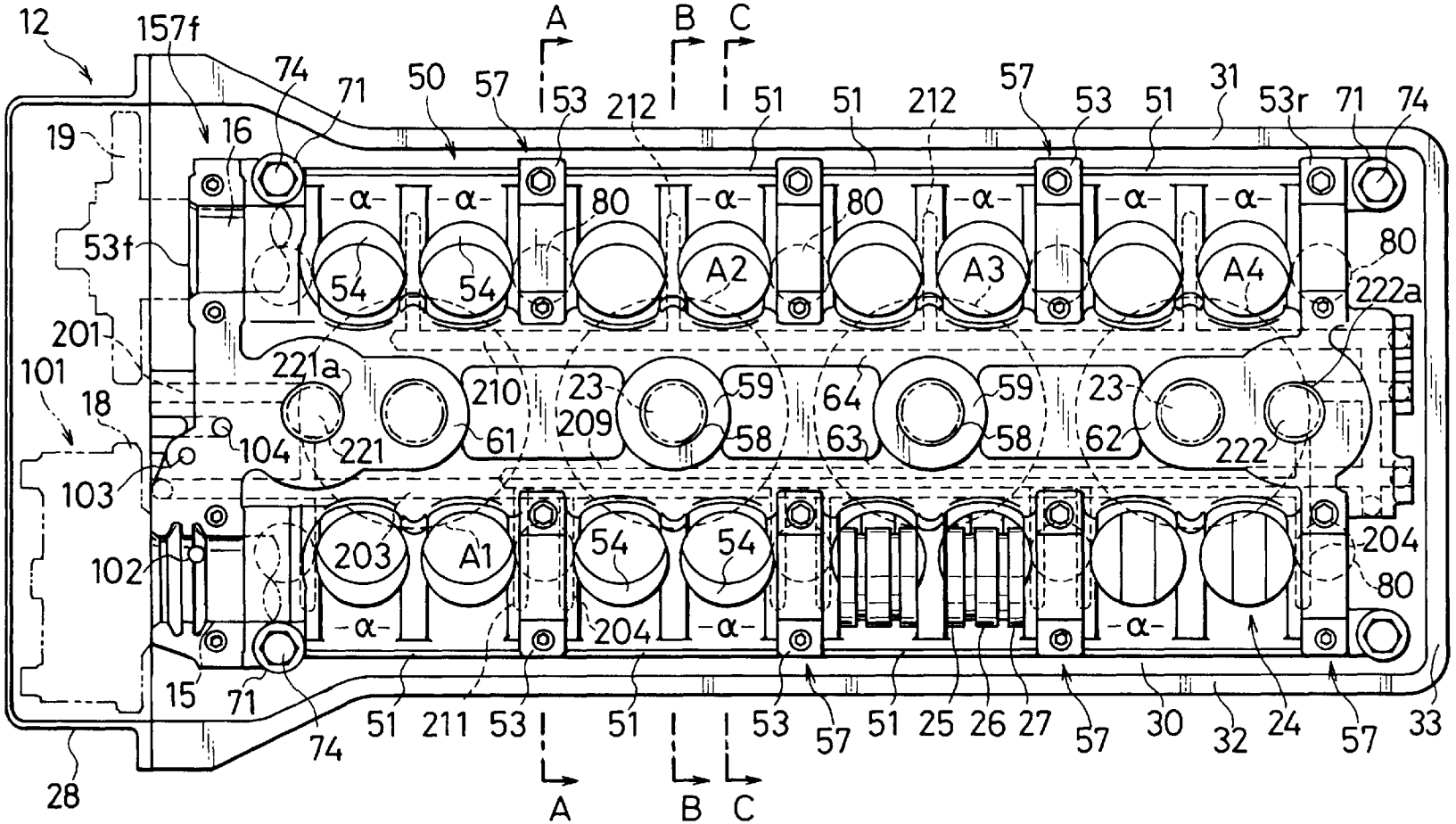
FIG. 2 is a top plan view of a cylinder head to which a carrier member is mounted.

FIG. 2 is a top plan view of the cylinder head 12 in the state when the head cover 13 is removed and a carrier member 50 described later is mounted. The intake camshaft 15 and exhaust camshaft 16 are disposed to longitudinally extend in parallel with each other, and an ignition plug 23 is provided for each of cylinders A1 to A4 (see FIG. 1). As is apparent from FIG. 2, this engine 1 is a four (4)-valve type, sixteen (16)-valve engine which has two intake ports Pinl, Pin2 and two intake valves 39, 39, and two exhaust ports Pex1, Pex2 and two exhaust valves 40, 40 for each of the cylinders A1 to A4. Correspondingly, four tappets 24,—, 24 are provided for each of the cylinders A1 to A4. This engine is also a variable valve control type engine wherein three cams 25, 26, 27 each having a different cam profile are provided for each valve 39, 40 and each corresponding tappet 24.

The cylinder head 12 includes a base portion 30, and sidewall portions 31, 32, 33 which are vertically protruded from the right, left, and rear marginal regions of the base portion 30, respectively, and are continuously connected with each other, as a fundamental structure. The front face of the cylinder head 12 has an opening in at least the region above the base portion 30. A cover member 28 is mounted over the front face of the cylinder block 11, cylinder head 12, and head cover 13 to protect the pulleys 17 to 21, the timing belt 22, and others.

Figure 3:
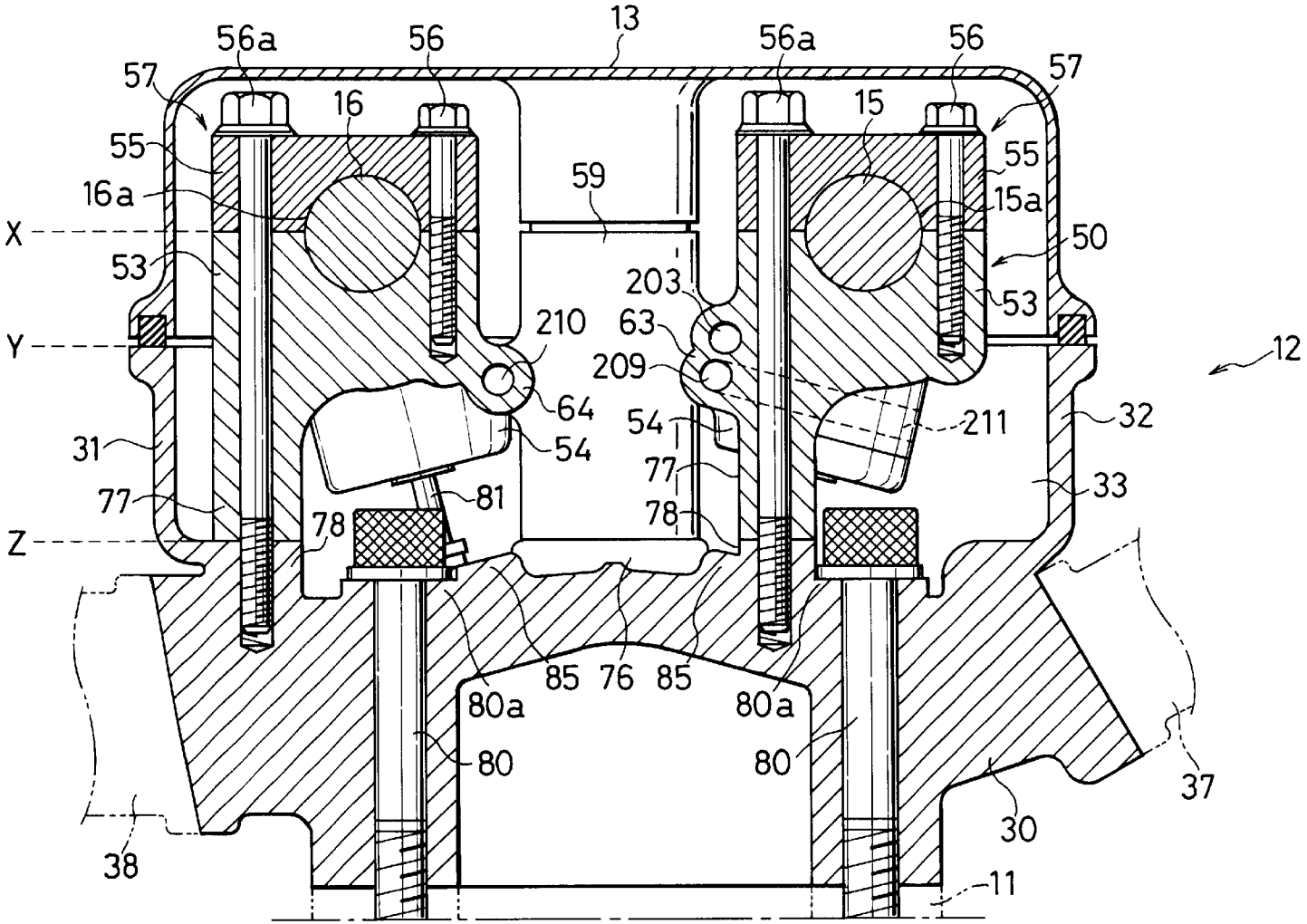
FIG. 3 is a vertical sectional view taken along the line A—A of FIG. 2.
Figure 4:
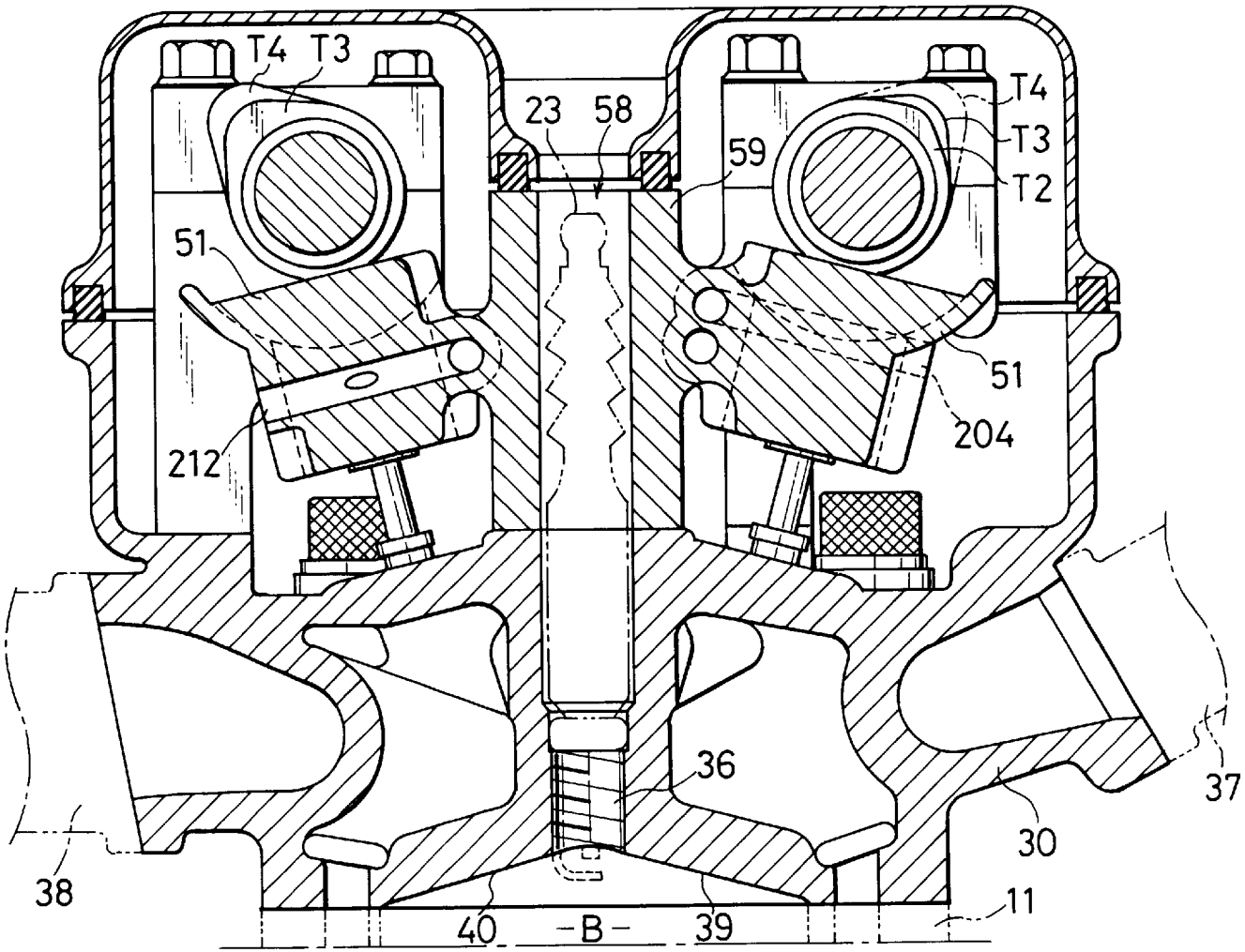
FIG. 4 is a vertical sectional view taken along the line B—B of FIG. 2.
Figure 5:
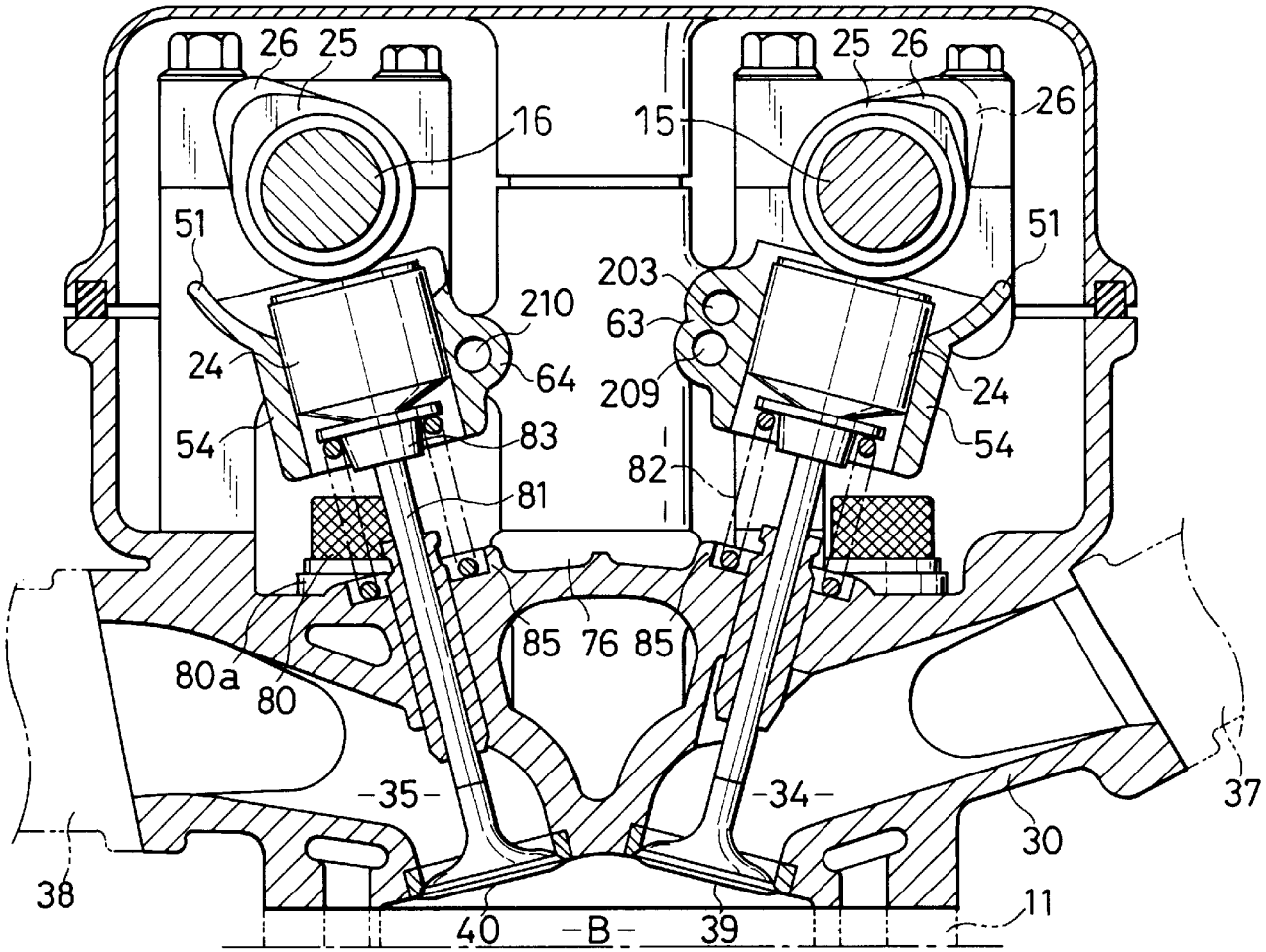
FIG. 5 is a vertical sectional view taken along the line C—C of FIG. 2.

FIGS. 3 to 5 are enlarged vertical sectional views showing the structure of the cylinder head 12. The base portion 30 of the cylinder head 12 is formed with the top region of respective combustion chambers B, —, B, intake ports 34, —, 34, and exhaust ports 35, —, 35, plugholes 36, —, 36 into which ignition plugs 23, —, 23 are attached with thread fastening. The intake ports 34, —, 34, exhaust ports 35, —, 35, and plugholes 36, —, 36 are opened to the combustion chambers B, —, B, respectively. Fuel injection nozzles (not shown), an intake manifold 37, an exhaust manifold 38, and others are also mounted to the base portion 30 of the cylinder head 12.

[Carrier member]

Figure 6:
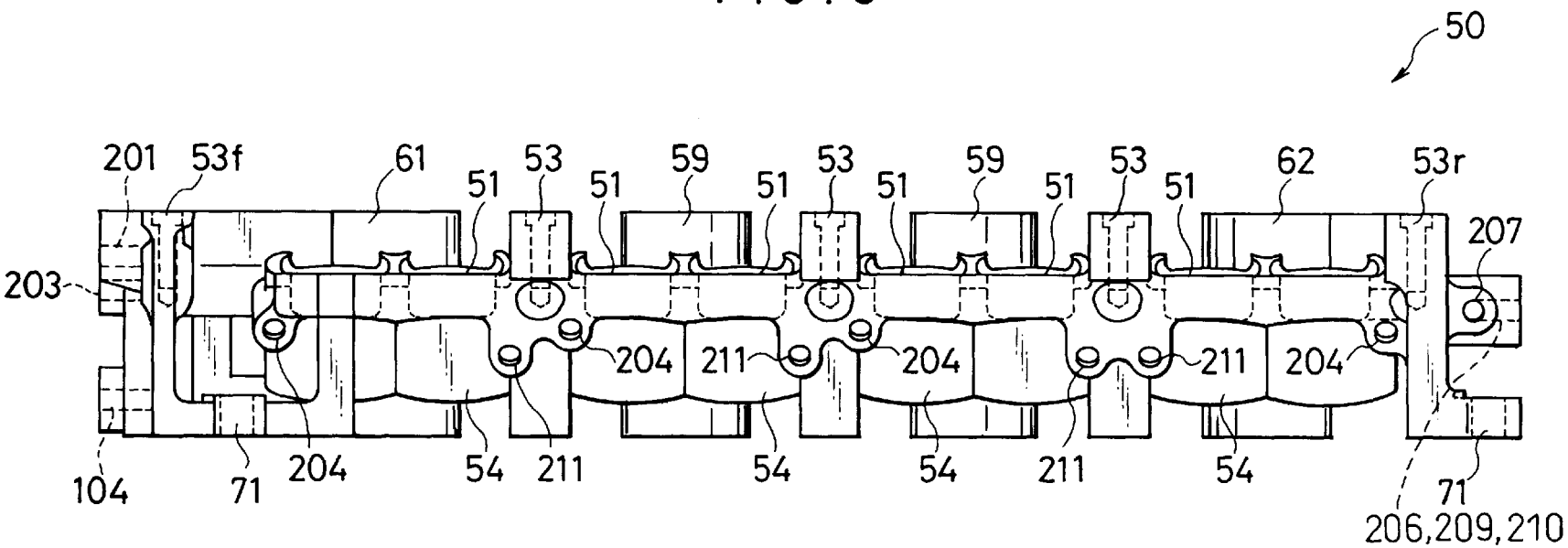
FIG. 6 is a right side view of a carrier member.
Figure 7:
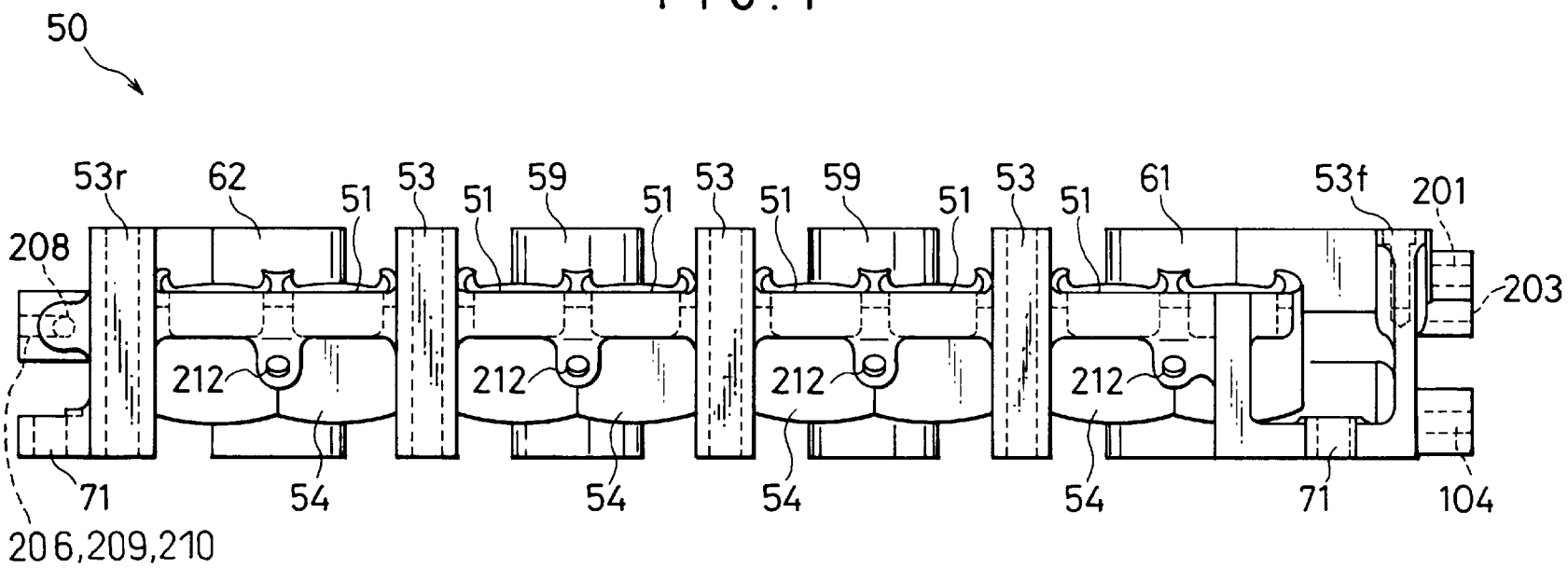
FIG. 7 is a left side view of a carrier member.

A carrier member 50 is provided on the upper surface of the base portion 30 of the cylinder head 12. This carrier member 50 horizontally extends within an upper space of the cylinder head 12 surrounded by the right, left, rear wall portions 31 to 33 of the cylinder head 12. As additionally shown in FIGS. 6 and 7, the carrier member 50 includes vertical wall portions 53, —, 53 supporting the lower portion of the camshafts 15, 16, tappet guides 54, —, 54 slidably containing and guiding the tappets 24, —, 24, and oil-receiving wall portions 51, —, 51 for receiving tappet-lubricating oil, which extend around the tappet guides 54, —, 54, as a fundamental structure. The vertical wall portions 53, —, 53, tappet guides 54, —, 54, and oil-receiving wall portions 51, —, 51 are formed integrally with the carrier member 50.

Each vertical wall portion 53 extends in vertical plain, and located on the left side or right side of the cylinders A1 to A4 and at approximately middle or central position between adjacent two of the cylinders A1 to A4 as shown in FIG. 2. A cam cap 55 for supporting each upper portion of the camshafts 15, 16 is mounted on the upper surface of each vertical wall portion 53 by bolts 56, 56*a*. Thus, bearing portions 57, —, 57 having journal portions 15*a*, —, 15*a* supporting the camshafts 15, 16 are provided (see FIG. 3 and FIG. 11).

Figure 12:
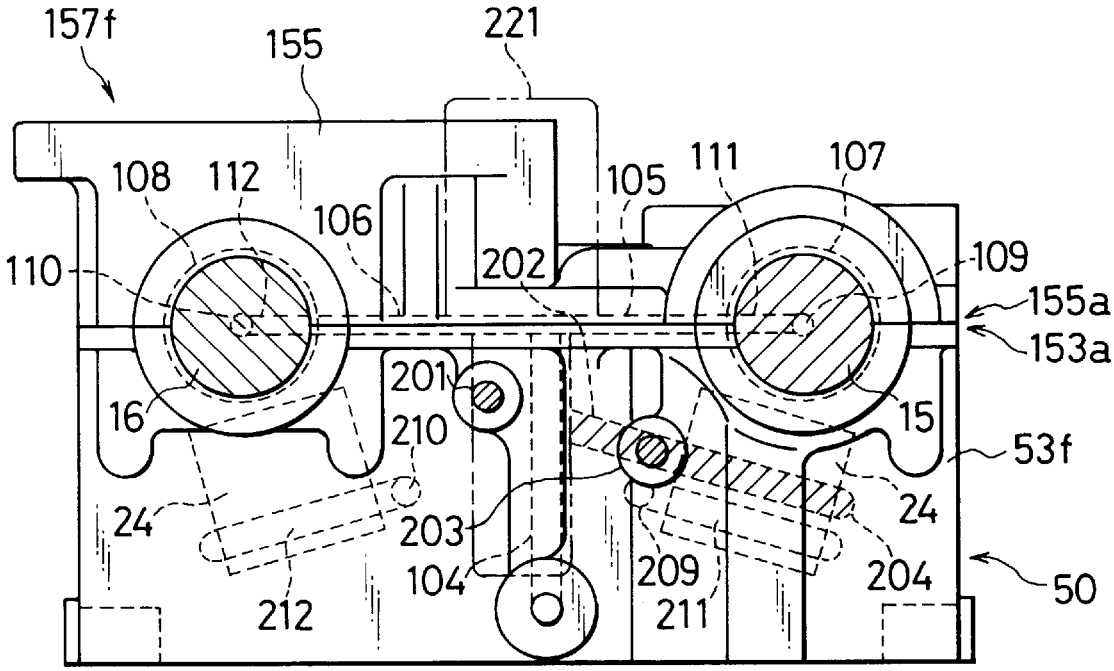
FIG. 12 is a schematic front view of the carrier member and a cam cap for showing the arrangement of the oil channel.

Referring to FIG. 2, while the bearing portions 57, —, 57 basically have a same configuration, respectively, and are arranged at constant intervals, a most-frontward vertical wall portion 53*f* and a most-rearward vertical wall portion 53*r* have a configuration different from other vertical wall portions, wherein the right and left vertical wall portions are configured in one unit. In particular, as shown in FIG. 12, a most-frontward bearing portion 157*f* is provided with a cam cap 155 in which the right and left cam caps are configured in one unit, and the distance between the most-frontward bearing portion 157*f* and the adjacent bearing portion 57 is lager than the aforementioned constant intervals.

As shown in FIGS. 3 to 5, each tappet guide 54 is formed in a cylindrical shape and the axis of the tappet guide 54 is slanted. The tappet guide 54 slidably carries or contains a tappet 24 which reciprocates the intake valve 39 or exhaust valve 40 by following the movement of the cams 25 to 27.

The carrier member 50 is also formed with apertures 58, —,58 into which the ignition plugs 23, —, 23 attached to the plugholes 36, —, 36 are inserted respectively. Specifically, a vertically extending cylindrical portion 59 is formed at the position directly above respective cylinders A1 to A4, and the vertically extending aperture 58 is formed in each cylindrical portion 59.

Referring to FIG. 2 again, the most-forward aperture 58 and the most-rearward aperture 58, however, are formed in columnar portions 61, 62, respectively. Each columnar portion 61 or 62 additionally have one of apertures 221*a*, 222*a* into which one of two oil-pressure control valves 221, 222 (see FIG. 10) is inserted, and each columnar portion 61 or 62 has a contour formed by two circles aligned in the longitudinal direction of the carrier member. These columnar portions 61, 62 are configured in one unit with the most-front vertical wall portion 53f and the most-rear wall portion 53*r*, respectively. The oil-pressure control valves 221, 222 control an operating oil pressure to a variable valve control devices housed in the tappets 24, —, 24, respectively.

As shown in FIGS. 3 to 5, the head cover 13 is contacted to the upper end surfaces of the right, left, and rear wall portions 31 to 33 of the cylinder head 12, the upper end surfaces of the cylindrical portions 59, 59, and columnar portions 61, 61 so as to be mounted to the cylinder head 12.

The carrier member 50 is also formed with ribs 63, 63 longitudinally extending at the positions between the cylindrical portions 59, 59/columnar portions 61, 61 and the tappet guides 54, —, 54. These ribs 63, 64 are formed with oil channels 203, 209, 210 for supplying the operating oil pressure to the variable valve control devices housed in the tappets 24, —, 24 (see FIG. 10).

Referring to FIG. 2 again, circular head bolt seat portions 71, —, 71 are formed at the front, rear, right, and left corners or four corners of the carrier member 50. The carrier member 50 is mounted to the cylinder head 12 by fastening the bolts 74, —, 74 to the seat portions 71, —, 71. In addition, for example, a cylindrical contacting protrusion protruded from the base portion 30 of the cylinder head 12 is provided, but not shown, for respective seat portions 71, —, 71 and the end surfaces of this contacting protrusion and the corresponding seat portion are closely pressed to each other, so that the carrier member 50 may be reliably secured to the cylinder head 12.

Referring FIGS. 3 to 5 again, matching protrusions 76, —,76 corresponding to the cylindrical portions 59, 59, in which the ignition plug insert aperture 58, —, 58 and the oil-pressure control valve insert apertures 221*a*, 222*a* are also formed, and the columnar portions 61, 62 are protruded from the base portion 30 of the cylinder head 12. The end surfaces of the matching protrusions 76, —,76 and the corresponding cylindrical portions 59, 59 and columnar portions 61, 62 are closely pressed to each other so that the carrier member 50 may further be reliably secured to the cylinder head 12.

As shown in FIG. 3, among the bolts 56, —, 56 securing the cam caps 55, —, 55 to the vertical wall portions 53, —, 53, some bolts 56*a* , —, 56*a* (in the illustrated example, all bolts on the left side in each of the vertical wall portions 53,—, 53, 53*r* other than the most-frontward vertical wall portion 157*f* penetrate the vertical wall portions 53, —, 53 and are installed or screwed into the base portion 30 of the cylinder head 12 so as to couple the cam caps 55, —, 55 with the vertical wall portions 53, —, 53 and simultaneously fasten the carrier member 50 to the cylinder head 12.

The carrier member 50 is formed with columnar portions 77, —, 77 extending downward at the position where the bolts 56*a* , —,56*a* for commonly fastening the cam caps 55, —, 55 and the carrier member 50 are located. In addition, matching protrusions 78, —, 78 corresponding to the columnar portion 77, —, 77 are protruded from the base portion 30 of the cylinder head 12. Thus, the end surfaces of the matching protrusions 78, —,78 and the corresponding columnar portions 77, —, 77 are closely pressed to each other so that the carrier member 50 may further be reliably secured to the cylinder head 12.

The cylinder head 12 is mounted to the cylinder block 11 by head bolts 80, —, 80 penetrating the base portion 30 and installed or screwed into the cylinder block 11, as shown in FIG. 3. In order to evenly receive the stress due to the combustion pressure in the cylinders A1 to A4 so as to reliably secure the cylinder head 12 to the cylinder head 11, the head bolts 80, —, 80 are located on the left and right sides of respective cylinders A1 to A4 and at approximately middle position between the adjacent cylinders.

[Tappet and Variable Valve Control Device]

Figure 8:
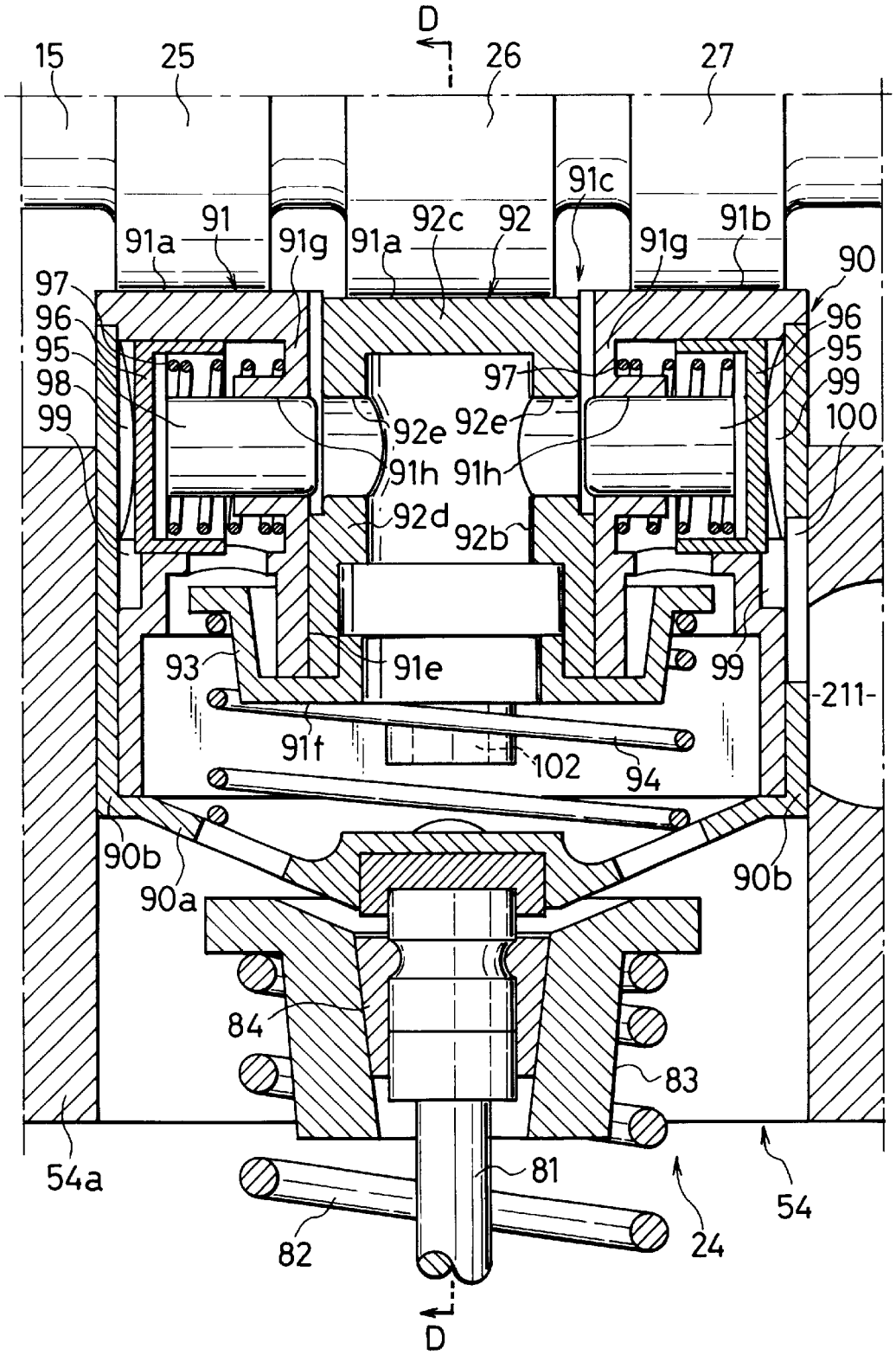
FIG. 8 is an enlarged vertical sectional view of a tappet for an intake valve, taken from the right side along the direction of the reciprocating motion thereof.
Figure 9:
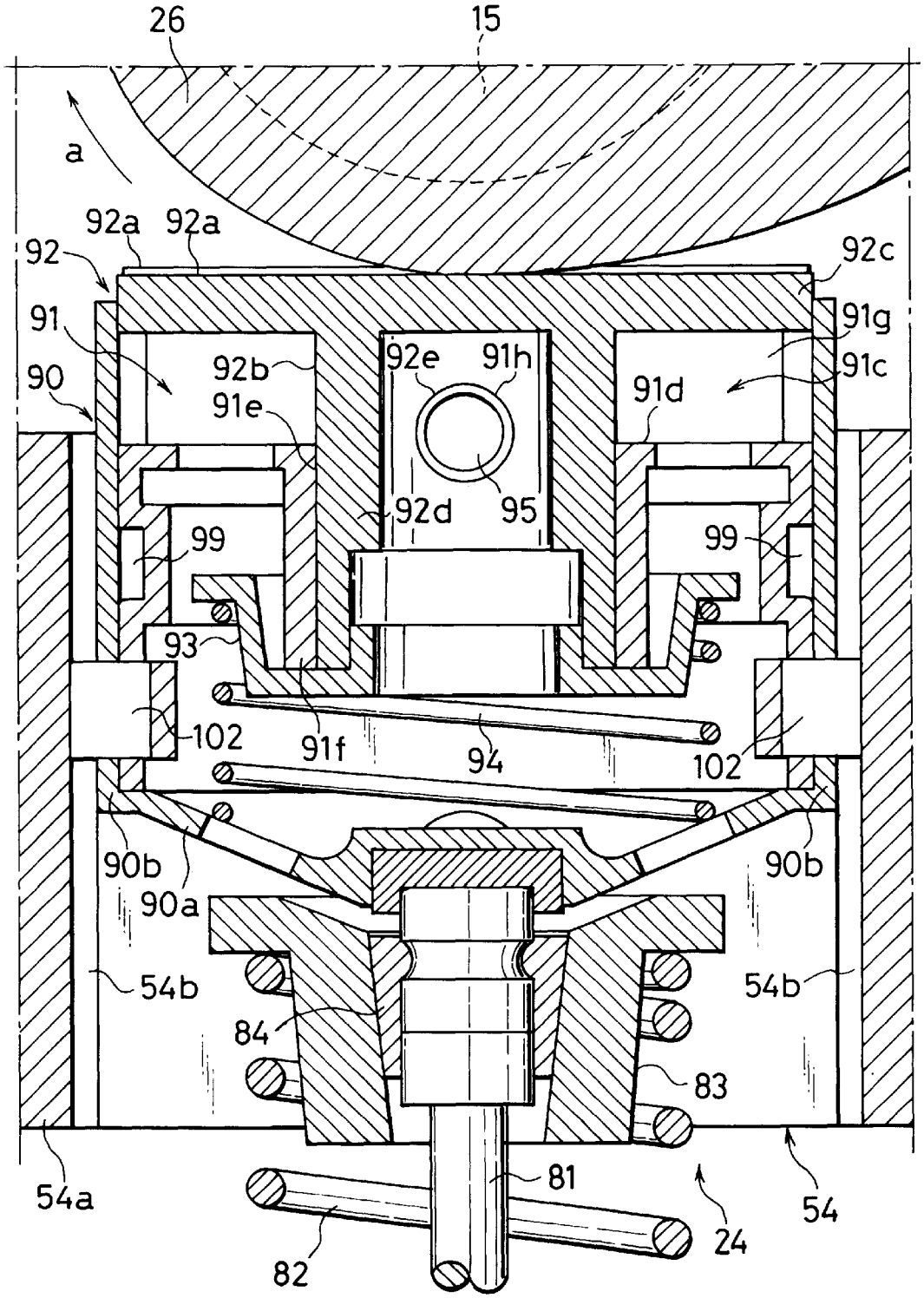
FIG. 9 is a vertical sectional view taken along the line D—D of FIG. 8.

With reference to FIGS. 8 and 9, the structure of the tappet 24 contained in the tappet guide 54 of the carrier member 50 will now be described.

Among the three cams 25 to 27 each having the different cam profile, the cams 25, 27 located at both ends have a same cam profile, and the cam 26 located at the center has a cam profile different from the end cams 25, 27. Specifically, the cams 25, 27 located at both ends have a lower lift amount, respectively, and the cam 26 located at the center has higher lift amount. The tappet 24 includes a first seat member 91 having contact surfaces 91*a*, 91*b*, which are contacted with the lower lift cams 25, 27, respectively, and a second seat member 92 having a contact surface 92*a*, which is contacted with the higher lift cams 26.

The first seat member 91 is coupled integrally to a cylindrical casing 90 defining a tappet body. The casing 90 is slidably contacted with the inner surface of the tappet guide 54. The lower portion 90a of the casing 90 is formed in a conical shape protruding downward. The stem end 81 of the intake valve 40 or exhaust valve 40 is contacted with the conical lower portion 90*a*. As is well known, the stem end 81 is provided with a spring seat 83 supporting one end of a valve spring 82 another end of which is engaged with the base portion 30 of the cylinder head 12, a valve cotter 84 for coupling the spring seat 83 and the end stem 81.

The first seat member 91 is basically comprised of a cylindrical member contacted with the inner surface of the casing 90, and the upper surface of the cylindrical member is notched radially with including the cylinder axis of the tappet 24 to form a grooved portion 91 a having a width about one-third of the diameter of the cylindrical member. Thus, the upper surface of the first seat member 91 is divided into two substantially semicircular regions to provide the contact surfaces 91*a*, 91*b* which is located at both ends of each tappet 24 and contacted with each lower lift cams 25, 27.

The second seat member 82 is configured movably in the direction of the reciprocating motion of the tappet 24 relatively to the first seat member 91 and the casing 90. Specifically, a circular aperture 91*e* in concentric relation with the cylinder axis of the tappet 24 is formed in the bottom surface 91*d* of the grooved portion 91*c* of the first seat member 91, and the cylindrical portion 92*b* of the second seat member 92 is slidably fitted in the circular aperture 91*e*. An extending portion 92*c* extending in the radial direction of the tappet 24 from the upper end of the cylindrical portion 92*b* is formed, and this extending portion 92*c* is adequately fitted in the grooved portion 91*c* of the first seat member 91. Thus, the upper surface of the second seat member 92 extends in the radial direction of the tappet 24 with being interposed between the two contact surfaces 91*a*, 91*b* of the first seat member 91, and is located at the center of the tappet 24 to provide the contact surface 92*a* contacted with the higher lift cam 26.

A spring seat 93 is provided at the lower edge of the cylindrical portion 92*b* of the second seat member 92. The second seat member 92 is continuously biased upward by a spring 94 interposed between the spring seat 93 and the lower conical portion 90*a* of the casing 90. At this moment, the spring seat 93 is contacted with the lower end portion of a cylindrical wall 91*f* defining the circular aperture 91*e* of the first seat member 91, and thereby the second seat member 92 is restricted to move upward. Thus, the height of the contact surface 92*a* of the second seat member 92 becomes substantially equal to that of the contact surfaces 91*a*, 91*b* of the first seat member 91.

The first seat member 91 and the second seat member 92 may be separated and combined in one unit by controlling lock pins 95, 95 housed in the first seat member 91. Specifically, openings 91*h*, 91*h*, 92*e*, 92*e* are formed in sidewalls 91*g*, 91*g* of the grooved portion 91*c* of the first seat member 91 defining a separation surface between both seat members 91, 91 and the inner wall 92*d* of the cylindrical portion 92*c* of the second seat member 92, respectively. Then, the lock pins 95, 95 located behind the sidewalls 91*g*, 91*g* of the grooved portion 91*c* are inserted into the openings 91*h*, 91*h* so as to be faced to the openings 92*e*, 92*e* of the second seat member 92, respectively.

Oil-pressure receiving caps 96, 96 each having a relatively large projected net area is provided behind the lock pins 95, 95, respectively. The lock pins 95, 95 and the oil-pressure receiving caps 96, 96 are continuously biased in the outward direction of the tappet 24 by springs 97, 97 wound around the lock pins 95, 95. Then, the oil-pressure receiving caps 96, 96 are contacted with the outer wall 90*b* of the casing 90. Thus, the lock pins 95, 95 are restricted to move outward, and the top portions of the pins 95, 95 are baked away within the openings 91*h*, 91*h* of the first seat member 91.

In this state, since both seat members 91, 92 are separated each other, even if the second seat member 92 is pressed by the higher lift cam 26, this pressing force is just absorbed by the spring 94 and never transferred to the casing 90. Thus, each movement of the tappet 24 and the valves 39, 40 is subject to the lower lift cams 25, 27 pressing the first seat member 91 continuously united with the casing 90.

Oil-pressure chambers 98, 98 are provided between the oil-pressure receiving caps 96, 96 and the outer wall of the casing 90. Specifically, a peripheral groove 99 is formed in the peripheral surface of the first seat member 91, while an oil aperture 100 is formed in the peripheral wall 90*b* of the casing 90. The oil aperture 100 and the oil-pressure chambers 98, 98 are configured to provide fluid communication with each other. Further, branched oil channels branched from respective oil channels 203, 209, 210 are formed in the peripheral wall 54*a* of the tappet guide 54 (see FIG. 10). In the example of FIG. 8, the branched oil channel is shown as a branched oil channel 211 branched from the oil channel 209. However, other oil channels 204, 212 may be configured in the same manner). The operating oil pressure regulated by the oil-pressure control valves 221, 222 is supplied to the oil-pressure chambers 98, 98 through the main oil channels 203, 209, 210, the branched oil channels 204, 211, 212, and the oil aperture 100 of the tappet 24.

Once the operating oil pressure is introduced in the oil-pressure chambers 98, 98, the oil-pressure receiving caps 96, 96 and the lock pins 95, 95 are moved inward against the biasing force of the springs 97, 97, and thereby the top portions of the lock pins is inserted into the second seat member 92 through the openings 92*e*, 92*e* of the second seat member. As a result, the lock pins 95, 95 lies inward beyond the separation surface between both seat members 91, 92 and locates to bridge between both seat members 91, 92.

In this state, since both seat members 91, 92 are coupled in one unit, once the second seat member 92 is pressed by the higher lift cam 26, this pressing force is transferred to the casing 90 through the lock pins 95, 95 and the first seat member 91. At this moment, the lower lift cams 25, 27 to press the first seat member 91 has a distance or space from the contact surfaces 91*a*, 91*b* and cannot be contacted with the contact surfaces 91*a*, 91*b* because the first seat member 91 is moved downward with the higher lift amount yielded by the second seat member. Consequently, each movement of the tappet 24 and the valves 39, 40 is subject to the higher lift cams 26 pressing the second seat member 92 united with the casing 90.

Thus, the valve lift amount and/or valve timing of the intake valves 39, —, 39 and/or exhaust valves 40, —, 40 may be varied by supplying and discharging the operating oil pressure from the oil-pressure control valves 221, 222. In this case, the separation surfaces between both seat members 91, 92 are provided in parallel with planes including the rotational loci of the cams 25 to 27, respectively, and thereby the contact surfaces 91*a*, 91*b*, 92*a* of respective seat member 91, 92 extend in parallel along the planes including the rotational locus of the cams 25 to 27, respectively. Thus, the lower lift cams 25, 27 is not contacted with the second seat member 92 and conversely the higher lift cams 25, 27 is not contacted with the first seat member 92, so that each cam profile of the cams 25 to 27 may be freely designed without any restriction of the design flexibility.

In order to adequately maintain the physical relationship of the seat member 91, 92 to the aforementioned cams 25 to 27 and the physical relationship of the oil aperture 100 to the branched oil channels 204, 211, 212, protruded members 102, 102 mounted in the peripheral wall 90*b* of the casing 90 may be engaged with guide grooves 54*b*, 54*b* formed in the inner surface of the tappet guide 54 to prevent the relative displacement.

[Features of Carrier member]

As described above, in the cylinder head structure of this engine 1, the carrier member 50, which is formed separately to the cylinder head 12 or is incorporated in the cylinder head 12 as an individual component, is provided as a cam carrier, and the vertical walls 53, —,53 supporting the camshafts 15, 16 and the tappet guides 54,—54 containing the tappets 24, —,24 are formed integrally with the carrier member 50. Thus, the vertical walls 53, —, 53 defining the bearing portions 57, —, 57 and the tappet guides 54, —, 54 guiding the tappets 24, —, 24 may be mounted to the cylinder head 12 at once only by mounting the carrier member 50 to the cylinder head 12. This allows the cylinder head structure to have the reduced number of parts, a simplified structure, and an enhanced layout performance. Further, an enhanced assembling operation performance of the cylinder head structure and a sufficiently downsized cylinder head structure may be achieved.

In this carrier member 50, the tappet-lubricating oil receiving wall portions 51, —, 51, the vertical wall portions 53, —, 53, the tappet guides 54, —, 54, and other components, which have different spatiality, different extending direction, and different configuration, respectively, are coupled with each other and thereby the carrier member 50 may have a higher rigidity or stiffness by a complementary relationship therebetween. This allows the camshaft 15,16, the tappet 24, —, 24, the oil-pressure control valve 221, 222 of the variable valve control device or the like to be reliably supported.

Further, since the carrier member 50 is formed separately to the cylinder head 12, the bearing portions 57, —, 57 defined by the vertical wall portions 53, —, 53 and the cam caps 55, —, 55 may avoid interfering with the cylinder head bolts 80, —, 80 and thereby the flexibility of the arrangement of the bearing portions 57, —, 57 is not restricted by the presence of the cylinder head bolts 80, —, 80. Thus, the bearing portions 57, —, 57 may be arranged overlappedly above the head bolts 80, —, 80 on the left side or right side of the cylinders A1 to A4 at the middle positions between adjacent cylinders.

In addition, the apertures 58, —, 58, 221*a*, 222*a* formed in the carrier member 50 serve as housings of the ignition plugs 23, —, 23 and the oil pressure control valves 221, 222. Thus, it is not required to additionally provide such housings, and thereby the number of parts of the cylinder head structure may further be reduced.

In this case, as compared with another case in which such housings are, for example, formed in the cylinder head 12, this case is superior in facilitating to form the plug housings 58, —, 58 or the valve housings 221*a*, 222*a* due to the simpler structure and smaller size of this carrier member 50. In addition, the rigidity of the carrier member 50 is further enhanced by providing such housings 58, —, 58, 221*a*, 222*a*.

Further, as compared with still another case in which the oil channels 203, 209, 210 for supplying the operating oil pressure to the variable valve control device housed in the tappet 24 are, for example, formed in the cylinder head 12, this case is also superior in facilitating to form the oil channels 203, 209, 210 due to the simpler structure and smaller size of this carrier member 50. In addition, the rigidity of the carrier member 50 is further enhanced by providing such oil channels 203, 209, 210.

In particular, providing the ribs 63, 64 to extend between the housings 58, —, 58, 221*a*, 222 *a* and the tappet guides 54, —, 54 allows the carrier member 50 to be further improved in rigidity. Additionally, providing the oil channels 203, 209, 210 in the ribs 63, 64 allows the ribs 63,64 to be further improved in rigidity, and this may yield further improved rigidity to the carrier member 50.

Further, since the carrier member 50 is fastened to the cylinder head 12 by using in common the bolts 56*a*, —, 56*a* for uniting the cam caps 55, -, 55 with the vertical walls 53, —, 53, the bolts may be used for dual purpose. This allows the cylinder head structure to have the reduced number of parts and a downsized structure.

Furthermore, the valve arrangement including the tappets 24, —, 24 and the camshafts 15, 16 for opening/closing the intake valves 39, —, 39 and the exhaust valves 40, —, 40 is supported by the carrier member 50 formed separately to the cylinder head 12, without any contact with the cylinder head 12. Thus, for example, various noises and vibrations caused by the rotation of the camshafts 15, 16, the confliction between the cams 25 to 27 and the tappet 24, or the sliding between the tappet 24 and the tappet guide 54 may be isolated within the carrier member 50. This may prevent such noises and vibrations from being transferred to the cylinder head 12 and the outside of the engine 1.

In this case, since the cylinder head is not particularly required to support the camshafts 15, 16, the height Y of the upper surface of the right, left and rear walls 31 to 33 of the cylinder head 12 is arranged lower than the height X of the upper surface of the vertical wall portions 53, —, 53 of the carrier member 50 supporting the camshafts 15, 16, as shown in FIG. 3.

Thus, the upper structure of the engine 1 may be constructed by increasing the usage of the head cover 13 capable of forming from lighter material than that of cylinder head 12, and decreasing the usage of the cylinder head 12 required to be formed from relatively heavier material. This allows the engine 1 to be reduced in weight.

Particularly, the above advantage is significantly effective in case that a valve arrangement is forced to have an increased overall height and the increased bearing height X of the camshafts 15, 16 due to the camshafts 15, 16 including the higher and lower lift cams 25 to 27, and the tappets 24, —, 24 including shift devices of the cams 25 to 27 (variable valve control devices).

Further, as shown in FIG. 3, the height Z of a matching face of the carrier member 50 and the cylinder head 12 is evenly arranged in totality. More specifically, in carrier member 50, all of the lower end surfaces of the circular protruded portions 71, —, 71, the cylindrical portions 59, 59, the columnar portions 61, 62, the columnar portions 77, —, 77 of the vertical wall portions 53, —, 53 are, for example, arranged evenly in height. In the cylinder head 12, all of the upper end surfaces of the matching portions 76, —, 76, 78, —, 78 are, for example, arranged evenly in height, and respective corresponding end surfaces of them are matched with each other at the same height Z in totality. .

In this case, in carrier member 50, the lower end surfaces of the cylindrical portions 59, 59 are the lower end surface of the whole. For example, the lower end surfaces of the tappet guides 54, —, 54 is not protruded downward beyond the lower end surfaces of the cylindrical portions 59, 59. In the cylinder head 12, the upper end surfaces of the matching portions 76, —, 76 are the upper end surface of the whole. For example, seat portions 80*a*, —, 80*a* of the cylinder head for the cylinder head bolts 80, —, 80 and seat potions 85 for the lower ends of the valve springs 82, —, 82 are not protruded upward at least beyond the matching portions 76, —, 76.

Thus, all of the end surfaces may be machined in the same height in a lump without machining the lower surfaces of the cylindrical portions 59, 59 one by one, or the upper surfaces of the matching portions 76, —, 76 one by one, so that the matching surfaces of the carrier member 50 and the cylinder head 12 may be machined with sufficiently enhanced workability. In addition, these matching surfaces may be machined with high degree of accuracy so that the carrier member 50 may be reliably secured to the cylinder head 12.

[Variable Valve Timing Device]

Figure 10:
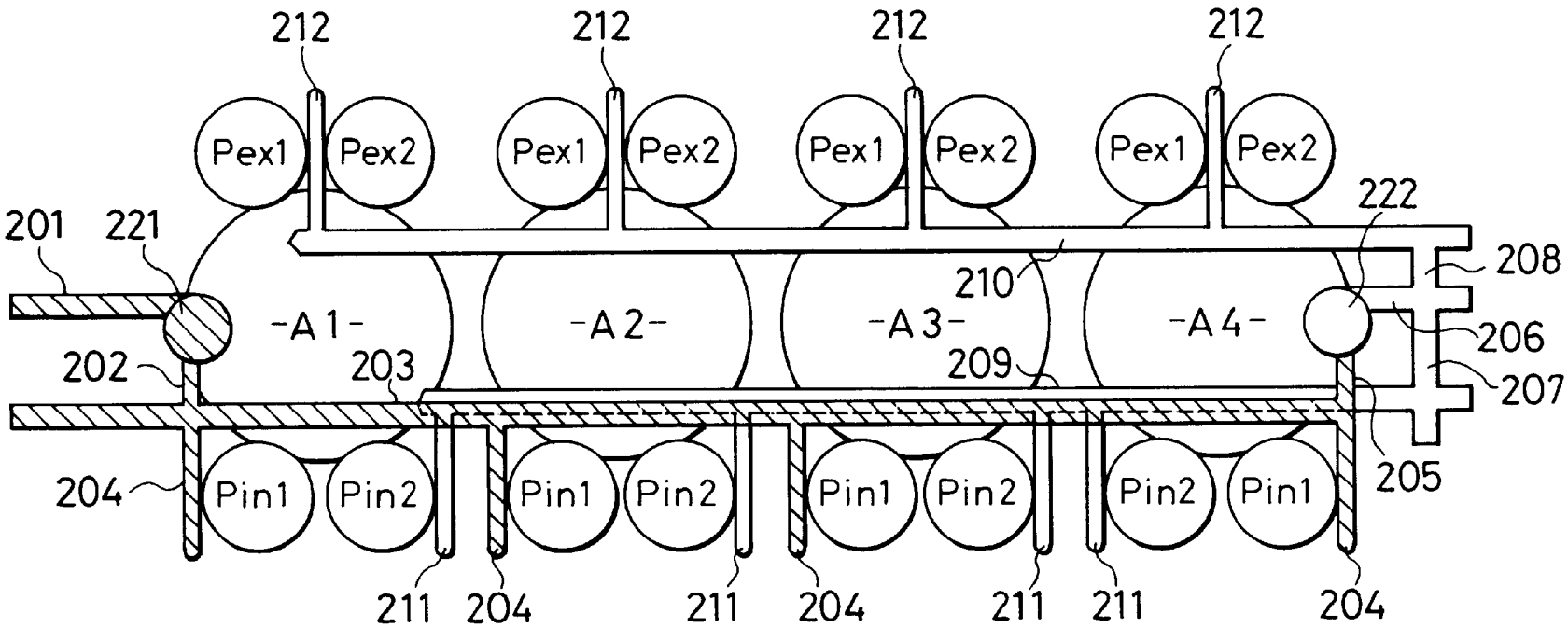
FIG. 10 is a schematic drawing showing the arrangement of an operating oil supply passage for a variable valve control device, which is formed in the carrier member.

As described above, this engine 1 includes two intake ports Pin1, Pin2 and two exhaust ports Pex1, Pex2 for each of four cylinders A1, A2, A3, A4 (see FIG. 10). Each of the total sixteen tappets 24, —, 24 contained in the tappet guides 54, —, 54 houses a variable valve control device (VVL) for varying the valve lift amount and valve opening-timing in response to the operating oil pressure (see FIGS. 8 and 9)

As shown in FIG. 2, this engine 1 is also provided with a variable valve timing (VVT) device 101 at the front-end portion of the intake camshaft 15. An oil-pressure control valve (not shown) for this VVT device 101 is provided within a chain case which is located at the front side of the engine 1 and coved by the cover member 28. An advance oil channel 102 for advancing the valve timing and a retard oil channel 103 for retarding the valve timing are formed in the front-end portion of the carrier member 50.

When the operating oil pressure is supplied from the advance oil channel 102 to the VVT device 101 according to the operation of the VVT oil-pressure control valve, a rotor (not shown) rotated integrally with the intake camshaft 15 is angularly displaced to the intake camshaft angle in the direction for advancing the valve timing. This causes the shift of the phase angle between the cam pulley 18 and the intake camshaft 15 and thereby the valve overlap period between the intake valve and exhaust valve is increased. Conversely, when the operating oil pressure is supplied from the retard oil channel 103 to the VVT device 101, the rotor is angularly displaced to the intake camshaft angle in the direction for retarding the valve timing. As a result, the valve overlap period between the intake valve and exhaust valve is reduced.

[Camshaft Lubrication]

Figure 11:
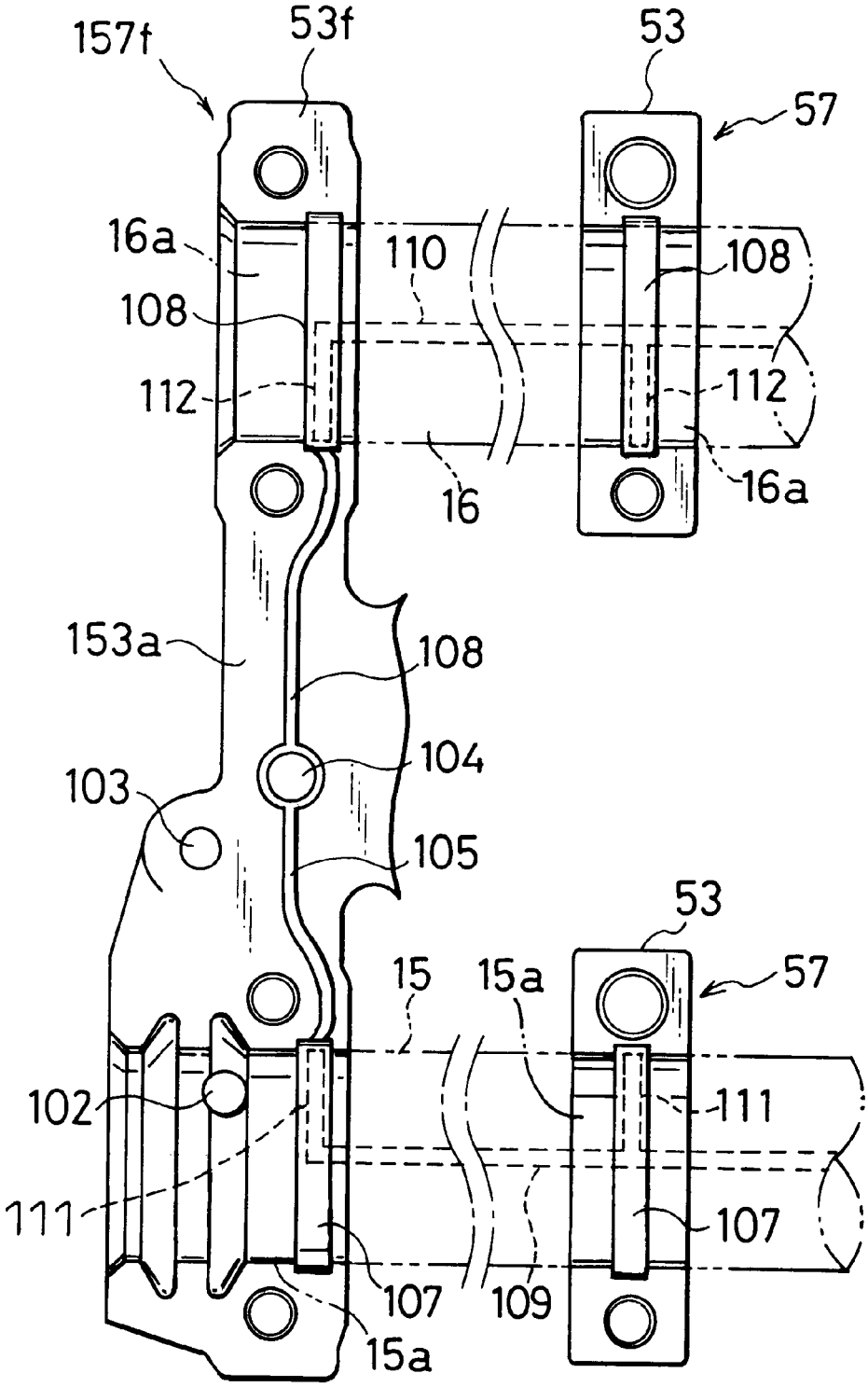
FIG. 11 is an enlarged top plan view of the front-end region of the carrier member for showing a lubricating oil channel of the camshaft.

Lubrication-oil supply passages to the camshafts 15, 16 will now be described. As shown in FIG. 11, among the vertical wall portions 53, —, 53 of the carrier 50, the most-frontward vertical wall portion 53*f* is configured to continuously connect the intake-valve and exhaust-valve sides thereof, and thereby a relatively wide and flat matching surface 153*a*. Correspondingly, as shown in FIG. 12, the cam cap 155 coupled with the most-frontward vertical wall 53*f* is also configured to continuously connect the intake-valve and exhaust-valve sides thereof, and thereby a relatively wide and flat matching surface 155*a*.

On the other hand, a camshaft-lubricating oil channel 104 is formed in the front-end portion of the carrier member 50. As best shown in FIG. 2, this oil channel 104 extends from the front-end surface of the carrier member 50 rearward to some extent, and then turns upward to reach the matching surface 153*a*. Oil grooves 105, 106 are provided in the matching surface 153*a* of the most-frontward vertical wall portion 53*f* and the matching surface 155*a* of the cam cap 155, respectively. These oil grooves 105, 106 are matched with each other to form the lubrication oil channels which horizontally extend from the camshaft-lubricating oil channel 104 toward the right-and-left intake-valve and exhaust-valve sides. The horizontal lubrication oil channels 105, 106 extend from the upper end of the vertical oil channel 104 to the cylindrical portion, which is contacted with the intake camshaft 15 or the journal portions 15*a*, 16*a* of the exhaust camshaft 16, in the most-frontward bearing portion 157*f*. A cylindrical tubular pin (not shown) having an oil aperture in the peripheral wall thereof is contained in the vertical oil channel 104.

Inner grooves 107, 108 are formed in the cylindrical portions, respectively. These inner grooves 107, 108 are also formed by matching the most-frontward vertical wall 53*f* and with the cam cap 155. The horizontal lubrication oil channels 105, 106 are configured to provide fluid communication with the inner grooves 107, 108, respectively.

The camshafts 15, 16 are formed with internal oil channels 109, 110 extending in the longitudinal direction thereof, respectively. Blanched oil channels 111, 112 are configured to branch from the internal oil channels 109, 110 and open to each inner surface of the journal portions 15*a*, —, 15*a*, 16*a*, —, 16*a*. The inner grooves 107, —, 107, 108, —, 108 are also formed in the inner surface of the cylindrical portion of the bearing portions 57, —, 57 other than the most-frontward bearing portion 157*f*, respectively.

According to the above construction, the lubrication oil supplied from the front-end surface of the carrier member 50 to the vertical lubrication oil channel 104 by an oil pump (not shown) is introduced into the camshafts 15,16 through the horizontal lubrication oil channels 105, 106 and the most-frontward inner grooves 107, 108. Then, in each of the journal portions 15*a*, —, 15*a*, 16*a*, —, 16*a*, the lubrication oil is supplied to the contact surfaces between the camshafts 15, 16 and the bearing portions 57, —, 57 through the branched oil channels 111, 112.

Thus, the lubrication to the camshafts 15, 16 may be achieved by providing the oil channels 104 to 106, inner grooves 107,108, or the branched oil channels 111, 112 in addition to the conventional members including the camshafts 15, 16, and the bearing portions 57, —, 57, 157*f*. Further, Any dedicated additional member is not required to lubricate the camshafts 15, 15 so that the structure of the carrier member 50 is not complexified and the carrier member 50 may be readily manufactured.

[Supply of Operating oil Pressure to Variable Valve Control Device]

The supply of the operating Oil pressure to the variable valve control device housed in the tappets 24, —, 24 will now be described. As shown in FIG. 2, FIG. 10, and FIG. 12, an oil channel 201 is formed to extend rearward from the front-end surface of the carrier member 50. This oil channel 201 is configured to provide fluid communication with a first oil-pressure control valve (OCV 1) 221 of the variable valve control device, which is inserted in the frontward columnar portion 61 having a shape formed of two aligned circles. When the OCV is turned off, the operating oil supplied to the oil channel 201 is blocked. When the OCV is turned on, the oil channel 201 may have fluid communication with the first main oil channel 203 through an intermediate oil channel 202 extending to the intake valve side.

As described above, the first main oil channel 203 is formed in the rib 63 (see FIGS. 2 and 3). Particularly in carrier member 50, the first main oil channel 203 extends in the longitudinal direction of the carrier member 50 at the position closer to the center side (or the cylinder A1 to A4 side, or inward) of the carrier member 50 than the tappet guides 54, —, 54. The branched passages 204, —, 204 extending in between the tappet guides 54, 54 (here, in between the guide tappets 54, 54 each interposing the vertical wall 53 and each belonging to different cylinders A1 to A4) in the lateral direction of the carrier member 50 (or in a direction opposite to the cylinder A1 to A 4, or outward) are formed in the same number as that of the cylinders A1 to A4. The branch passage 204 has fluid communication with the tappet guide 54 associated with one intake port Pin1 of respective cylinders A1 to A4 so as to supply the operating oil pressure to the variable valve device housed in the tappet 24. Thus, when the OCV is turned on, the intake valve 39 of said one intake port Pin1 may be increased in the lift amount.

Figure 14:
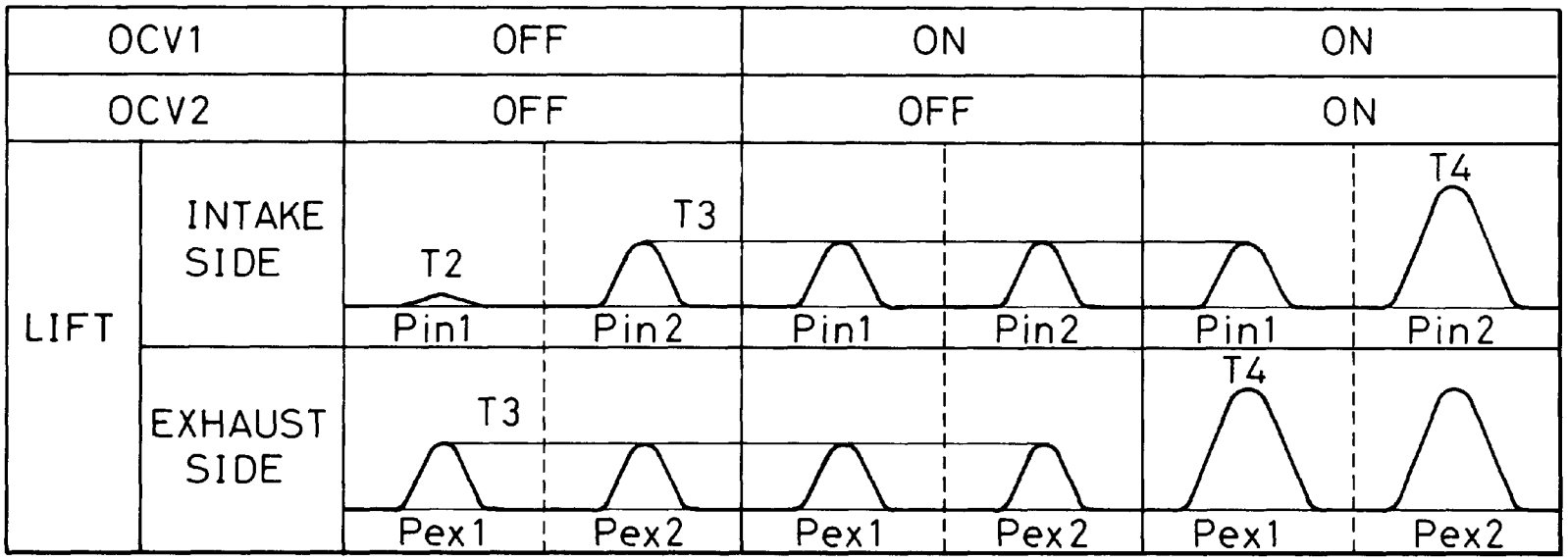
FIG. 14 shows the relationship between the ON/OFF pattern of an oil-pressure control valve of the variable valve control device and the lift amount of each valve.

Specifically, as shown in FIG. 14, once the OCV1 is turned on, the lift amount of the first intake port Pin1 is increased from T2 to T3. Here, the lift amount T2 is very small value (see FIGS. 4 and 5). Thus, During the OCV is turned off, the valve is in halt condition, and thereby an intake air is inducted into the combustion chambers B, —, B only through another one valve. As a result, excellent fuel-efficient may be achieved. On the other hand, once the OCV is turned on, both intake ports Pin1, Pin2 may be activated so that an efficient run suitable for medium-speed with relatively high engine speed may be provided.

Figure 13:
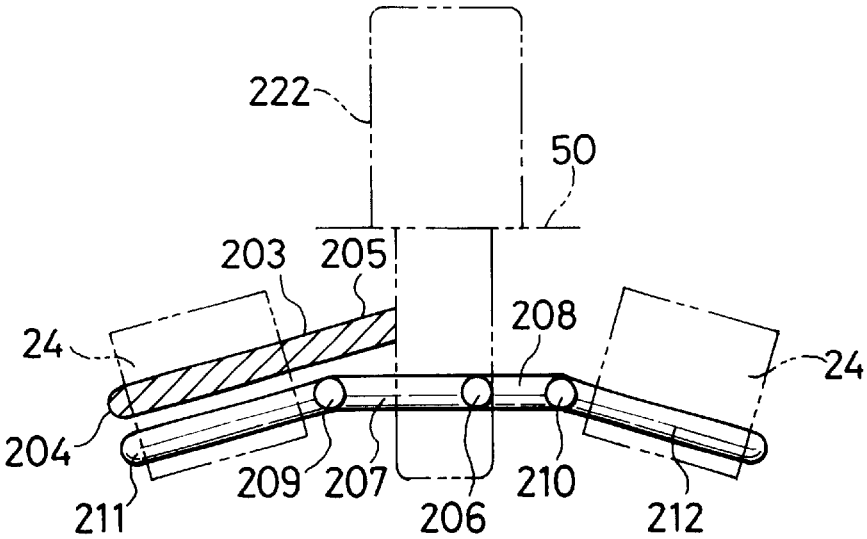
FIG. 13 is a schematic view showing the arrangement of the oil channel taken from the backside of the carrier member.

As shown in FIG. 10, only the fourth cylinder A4 has a particular arrangement of the intake ports Pin1, Pin2 different from other cylinders A1 to A3. The main oil channel 203 has fluid communication with the second oil-control valve (OCV2) 222 through an intermediate oil channel 205 continuously connected to the branched passage 204 for the fourth cylinder A4 (FIG. 13).

When this second OCV 222 is turned off, the operating oil in the first main oil channel 203 is blocked. When the OCV 222 is then turned on, the main oil passage 203 has fluid communication with the second and third main oil channels 209, 210 through an intermediate oil channel 206 extending rearward, a pair of intermediate oil channels 207, 208 extending from the intermediate oil passage 207, 208 to the intake valve and exhaust valve sides, respectively.

As shown in FIGS. 2 and 3, the second and third main oil channels 209, 210 are formed in the right-and-left rib 63, 64, respectively, as in the first main oil channel 203. Particularly in the carrier member 50, the second and third main oil channels 209, 210 extend in the longitudinal direction of the carrier member 50 at the position closer to the center side of the carrier member 50 than the tappet guides 54, —, 54.

In the second main oil channel 209 on the intake valve side, the branched passages 211, —, 211 extending in the lateral direction of the carrier member 50 have fluid communication with the tappet guide 54 of the second intake port Pin2 of respective cylinders A1 to A4 so as to supply the operating oil pressure to the variable valve device housed in the tappet 24.

In the third main oil channel 210 on the exhaust valve side, the branch passages 212, —, 212 extending in between the tappet guides 54, 54 (here, in between the tappet guides 54, 54 within a same cylinder in the cylinders A1 to A4) in the lateral direction of the carrier member 50 simultaneously has fluid communication with the tappet guides 54, 54 of both intake ports Pex1, Pex2 of cylinders A1 to A4 so as to supply the operating oil pressure to the variable valve devices housed in both tappets 24, 24.

Thus, when the OCV is turned on, the intake valve 39 of the second intake port Pin2 is increased in the valve lift amount and the exhaust valve 40, 40 of the both exhaust pots Pex1, Pex2 are increased in the valve lift amount More specifically, as shown in FIG. 14, once the OCV is turned on, the valve lift amount of the second intake port Pin2 and the valve lift amount of the first and second exhaust ports Pexl, Pex2 are increased from T3 to T4, respectively, so that an efficient run suitable for high-speed with high engine speed may be provided.

Thus, in the intake valve side, the first main oil channel 203 has fluid communication with the first tappet guide (Pin1) through the branched oil channel 204, and the second main oil channel 209 has fluid communication with the second tappet guide (Pin2) through the branched oil channel 211, so that the variable valve control devices of two tappets 24, 24 of Pin1, Pin2 may be separately and independently controlled.

In the exhaust valve side, the third main oil channel 210 simultaneously has fluid communication with both tappet guides (Pex1, Pex2) through the branched oil channel 212 so that the variable valve control devices of two tappets 24, 24 of Pex1, Pex2 may be simultaneously controlled.

Extending the oil supply passages 203, 209, 210 of the variable valve control device in the direction of the arrangement of the tappet guides 54, —, 54 allows the operating oil pressure to be reliably supplied to the variable valve control device and allows the rigidity of the carrier member 50 to be further enhanced.

Further, since this cylinder head structure is applied with a so-called inter-bore bearing; specifically the vertical wall portions 53, —, 53 (bearing portion 57, —, 57) for supporting the camshafts 15, 16 are arranged between the adjacent bores (between adjacent cylinders A1 to A4), the overall valve system may be compactly arranged, and thereby the downsizing of the carrier member 50, the reliable rigidity of the cylinder head structure, and the oil distribution to the variable valve control device may be satisfactorily enhanced all at once. In addition, the cams 25 to 27 may be arranged to intake/exhaust ports or tappet guides 54, —, 54 with sufficient flexibility, and thereby a high-performance variable valve control device having a plurality of cams 25 to 27 for each cylinder (in this example, three cams) may be freely mounted.

Figure 15:
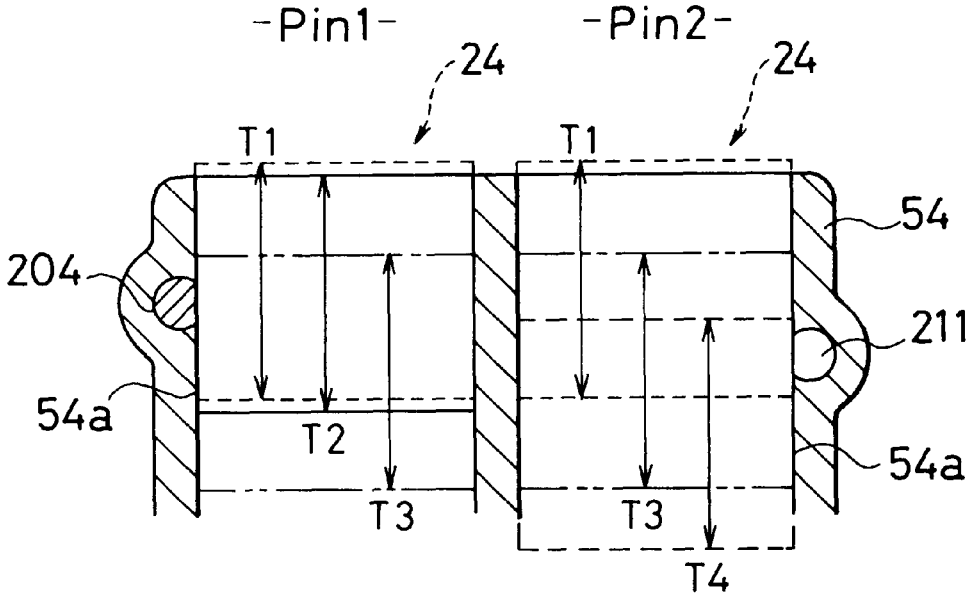
FIG. 15 is a schematic side view of a tappet guide for the intake valve to illustrate the relationship between the height of the channel and the lift amount.
Figure 16:
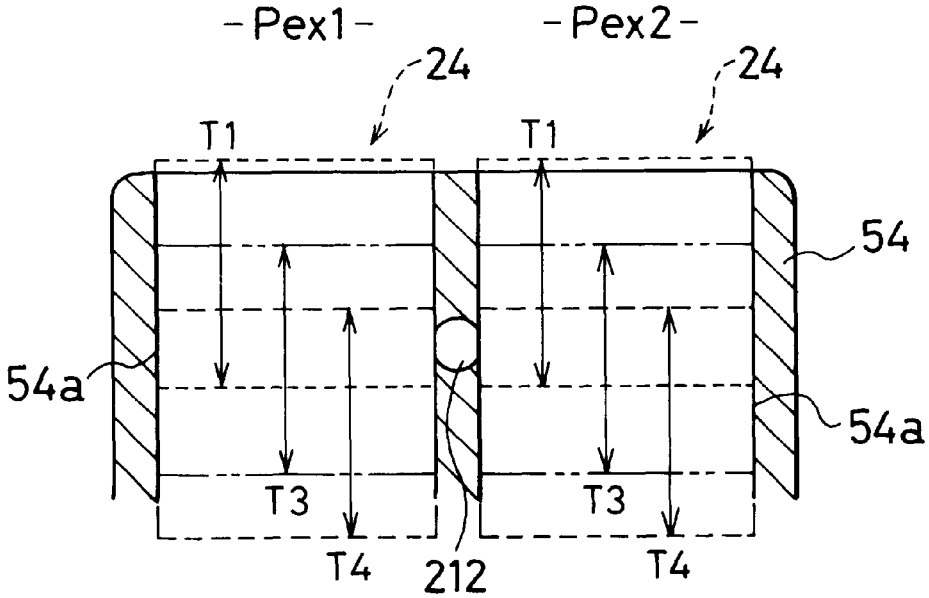
FIG. 16 is a schematic side view of a tappet guide for an exhaust valve to illustrate the relationship between the height of the channel and the lift amount.

As shown in FIGS. 3 to 5, the first main oil channel 203 is arranged at a relatively high position and the second, while third oil channels 209, 210 is arranged at a relatively low position. This is done because, as shown in FIG. 14, even when the intake valve 39 of the first port (Pin1) in two intake ports is increased in valve lift amount, the increased lift amount T3 is relatively small, but when the intake valve 39 of the second port (Pin2) and the exhaust valve 40 of exhaust ports (Pex1, Pex2) are increased in valve lift amount, the increased lift amount T4 is relatively large, As shown in FIGS. 15 and 16, the lowered amount of the tappet 24 is large as the valve lift amount is large. Thus, when the tappet 24 is lowered, the opening of the branched oil channels 204, 211 are exposed to leak the operating oil, and thereby the operating oil pressure tends to be decreased. For the measure of this problem, in the second intake port (Pin2) having a large valve lift amount and two exhaust valves (Pex1, Pex2), the third main oil channels 209, 210 and the branched oil channels 211, 212 is located at a relatively low position.

In contrast, the lowered amount of the tappet 24 is small as the valve lift amount is small. Thus, even if the first main oil channel 203 and the branched oil portion are arranged at the relatively high position, the above undesirable problem may be avoided. In FIGS. 15 and 16, the symbol T1 indicates a reference edge or the position for providing zero valve-lift amount.

Thus, in this engine 1, the valve opening motion of the intake valve 39 and exhaust valve 40 is varied in two stages by sequentially turning on the first and second oil-control valve 221, 222. The variance in the first stage may be achieved by supplying the operating oil pressure only to the first main oil channel 203 (the operating oil is supplied to the shaded portion particularly shown in FIGS. 12 and 13). The variance in the second stage may be achieved by supplying the operating oil pressure additionally to the second and third main oil channels 209, 210 (the operating oil is supplied to the non-shaded portion particularly shown in FIGS. 12 and 13).

At this moment, the first main oil channel 203 serves as a oil channel to supply the operating oil to the first intake ports Pin1, —, Pin1 so as to provide the variance of the first stage, and additionally as a transit passage of the operating oil for supplying the operating oil pressure to the second and third oil channel 209, 210. Thus, it is advantageously unnecessary to provide additional transit passage of the operating oil yielding the variance of the second stage.

Further, a valve lash adjuster (VLA) device may be provided for automatically adjusting valve clearance to reducing noise, and a oil channel for supplying oil pressure to this device may be formed in the carrier member 50 in the same manner as described above. Preferably, the oil channel for the VLA device is arranged at the outboard position of the carrier member 50, while the oil channel for the WT device is arranged at the inboard position of the carrier member 50. Conversely, if the oil channel for the VLA device involving less number of oil channels is arranged at the inboard position of the carrier member 50, and the oil channel for the VVT device involving lager number of oil channels is arranged at the out board position of the carrier member 50, the operating performance or workability for drilling the oil channels is deteriorated. Further, the carrier member 50 is unreasonably increased in weight due to an increased size of the rib provided outward, resulting in an increased weight of the cylinder head 12.

[Lubrication of Tappet]

The lubrication of the tappets 24, —, 24 themselves within the guides 54, —, 54 will now be described. As shown in FIGS. 4 to 7, in the carrier member 50, the wall portion 51, —, 51 coupling the tappet guide with the vertical wall 53, —, 53 is provided around the tappet guide 54, —, 54. This wall portion 51 is protruded upward in the outward direction and inward direction of the carrier member 50, and slightly slanted toward the tappet guide 54, —, 54. Thus, the lubrication oil is collected close to the tappet 24,—, 24 within the tappet guide 54, —, 54, and thereby the wall portion 51 may provide the tappet-lubricating oil receiving portion ($\alpha$) (see FIG. 2).

As a result, for example, this oil receiving portion a may receive the lubrication oil for the can shaft 15, 16 dropping from the bearing portion 57, —, 57, and then make a flow toward the tappet 24, —,24 contained in the tappet guide 54, —,54 to use as an external lubrication system for the tappet 24, —, 24. Further, any dedicated oil supply passage for lubricating the tappet 24, —, 24 is not required to provide in the carrier member 50 so that the carrier member 50 may avoid to be complexified in structure and readily manufactured.

In addition, the oil-receiving portion α for receiving the tappet lubricating oil is surrounded by the wall portion 51, —, 51 directed upward and the vertical wall portion 53, —, 53 which is increased in height by coupling the cam cap therewith, and this bearing portion 57, —, 57 is used as a oil separator. Thus, the oil collected in the oil-receiving portion a may avoid to be excessively reduced and thereby sufficient lubrication of the tappet may be reliably maintained even by the external lubrication system. The curved oil-receiving wall portion 51, —, 51 may provide an enhanced rigidity of the carrier member 50.

According to the present invention, a carrier member formed integrally with a vertical wall portion supporting a camshaft and a tappet guide containing a tappet is formed separately to a cylinder head, and mounted to the cylinder head. Thus, the interference between a head bolt and the bearing potion of a camshaft may be avoided. This allows the cylinder head structure to have the reduced number of parts, an enhanced layout performance and an enhanced supporting rigidity. Further, according to the present invention, this cylinder head structure includes the carrier member as described above, a tappet having a variable valve control device built-in, an operating oil supply passage, formed in the carrier member, for the variable valve control device, an oil-receiving portion around the tappet, and a lubrication system for the camshaft. Thus, sufficient lubrication oil may be distributed to an overall valve arrangement. The present invention may be suitably applied to various type of engines including a tappet type engine having a tappet for transfer reciprocating motion to valves with driven by cams, an engine having a tappet housing a variable valve control device, and a DOHC engine which tends to have a complicate structure.

What is claimed is:

1. A cylinder head structure for an engine including a tappet which houses a variable valve control device for varying at least one of valve-lift amount and valve-opening timing, said cylinder head structure comprising;

a carrier member integrally formed with a vertical wall portion located between adjacent cylinder bores, and a tappet-carrying portion for containing said tappet for an intake port or exhaust port, said carrier member formed separately from a cylinder head, wherein said vertical wall portion includes a bearing portion for supporting a camshaft;

an oil supply passage for said variable valve control device, provided in said carrier member at the position closer to the central region of said carrier member than the position of said tappet-carrying portion, said oil supply passage extending in the direction in which said tappet-carrying portion is arranged in said carrier member;

an oil-receiving portion for receiving a tappet-lubricating oil, provided around said tappet-carrying portion, said oil-receiving portion including a wall portion extending upwardly and outwardly from the tappet-carrying portion so as to receive a lubrication oil to lead to the tappet, wherein said oil-receiving portion couples said tappet-carrying portion with said vertical wall portion, and a marginal region of said oil-receiving portion is directed upward;

wherein said camshaft is provided with an internal oil channel extending in the longitudinal direction of said camshaft and an oil channel branched from said internal oil channel at a portion where said camshaft is supported by said camshaft wherein said bearing portion is provided with an inner groove opposed to said opening of said oil channel, and said bearing portion supporting an end of said camshaft is provided with a camshaft-lubricating oil channel configured to provide fluid communication with said inner groove.

2. A cylinder head structure as defined in claim 1, wherein said oil supply passage for the variable valve control device, includes a branched passage within said tappet-carrying portion, said branched passage extending in the lateral direction of said carrier member, wherein said tappet-carrying portion so as to supply oil to said variable valve control device.

3. A cylinder head structure as defined in claim 1, said carrier member further having a first mating surface mating with said cam cap and a second mating surface mating with a base portion of a cylinder head of said engine, respectively, and a columnar portion vertically extending between said first and second surfaces, wherein said second mating surface is located at the position corresponding to that between adjacent cylinder bores, and on the lateral side with respect to said intake port or exhaust port in the rotation direction of a crankshaft of said engine, said cylinder head structure further comprising, a first bolt for fastening in common said cam cap and said columnar portion to said cylinder block by penetrating said first and second mating surfaces, a second bolt for fastening said cam cap to said columnar portion by penetrating said first mating surface, wherein said camshaft is located between said first and second bolts, and a third bolt for fastening said base portion of the cylinder head to said cylinder block, an upper end of said third bolt being located under a lower end of said second bolt with respect to said first mating surface.

4. A cylinder head structure for a DOHC engine including a tappet which houses a variable valve control device for varying at least one of valve-lift amount and valve-opening timing, said cylinder head structure comprising;

a carrier member integrally formed with a vertical wall portion located between adjacent cylinder bores and formed with intake and exhaust cam journal portions, and an intake and exhaust tappet-carrying portions and a lip member in which an oil channel extending in a longitudinal direction is formed between the intake and exhaust tappet-carrying portions, said carrier member being formed separately from a cylinder head, wherein said vertical wall portion includes a bearing portion for supporting a camshaft, and said tappet-carrying portion is located between said vertical wall portions adjacent to each other, a cam cap for supporting the camshaft in cooperation with said vertical wall portion, said cam cap couple with said vertical wall portion; and an oil-receiving portion for receiving a tappet-lubricating oil, provided around said tappet-carrying portion of said carrier member, said oil-receiving portion including a wall portion extend upwardly and outwardly from the tappet carrying portion so as to receive a lubrication oil to lead to the tappet, wherein said oil-receiving portion couples said tappet-carrying portion with said vertical wall portion, and a marginal region of said oil-receiving portion is directed upward, wherein said camshaft is provided with an internal oil channel extending in the longitudinal direction of said camshaft and an oil channel branched from said internal oil channel at the portion where said camshaft is supported by said bearing portion, said oil channel opened at the peripheral surface of said camshaft, wherein said hearing portion is provided with an inner groove opposed to said opening of said oil channel, and said bearing portion supporting the edge of said camshaft is provided with a camshaft-lubricating oil channel configured to provide fluid communication with said inner groove.

5. A cylinder head structure for a multiple cylinder engine including a tappet which houses a variable valve control device for varying at least one of valve-lift amount and valve-opening timing, said cylinder head structure comprising:

a carrier member integrally formed with a vertical wall portion located between adjacent cylinder bores, and a tappet-carrying portion for containing said tappet for an intake port or exhaust port, said carrier member formed separately to a cylinder head, wherein said vertical wall portion includes a bearing portion for supporting a camshaft;

an oil supply passage for said variable valve control device, provided in said carrier member at the position closer to the central region of said carrier member than the position of said tappet-carrying portion, said oil supply passage extending in the direction in which said tappet-carrying portion is arranged in said carrier member; and an oil-receiving portion for receiving a tappet-lubricating oil, provided around said tappet-carrying portion, said oil-receiving portion including a wall portion extend upwardly and outwardly from the tappet carrying portion so as to receive a lubrication oil to lead to the tappet, wherein said oil-receiving portion couples said tappet-carrying portion with said vertical wall portion, and a marginal region of said oil-receiving portion is directed upward, a first intake valve with a smaller valve lift amount, a second intake valve with a larger valve lift amount than the first intake valve, said tappet including a first tappet corresponding to said first intake valve and a second tappet corresponding to said second intake valve, said oil supply passage for said variable valve control device including a first oil passage in fluid communication with said first tappet and a second oil passage corresponding to said second intake valve said first oil passage being disposed over the second oil passage and said first and second oil passages supplying the operating pressure to said first and second tappets independently said tappet including a first seat member operably connected to the intake valve or exhaust valve, and a second seat member separably associated with said first seat member, said camshaft including a first cam having a lower lift cam profile and a second cam having a higher lift cam profile, wherein said first and second cams are associated with said first and second seat members, respectively.

6. A cylinder head structure as defined in claim 5 wherein a first oil-pressure control valve for controlling a hydraulic pressure in a first oil passage is provided in title carrier member at a first end of the multiple cylinder engine and a second oil-pressure control valve for controlling a hydraulic pressure in a second oil passage is provided in the carrier member at a second end of the multiple cylinder engine.

7. A cylinder head structure as defined in claim 6 wherein a variable valve lift control device is provided for an exhaust valve tappet and wherein a third oil channel for an exhaust valve extending in the longitudinal direction is provided in parallel with the longitudinal oil channels for an intake valve so that the second oil-pressure control valve controls a hydraulic pressure in the third oil channel concurrently with the second oil channel.

* * * * *